US008016053B2

(12) United States Patent
Menezes et al.

(10) Patent No.: US 8,016,053 B2
(45) Date of Patent: Sep. 13, 2011

(54) DRILL BIT CONFIGURATIONS FOR PARKED-BIT OR THROUGH-THE-BIT-LOGGING

(75) Inventors: Clive D. Menezes, Conroe, TX (US); Daniel J Krueger, Pearland, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 12/016,735

(22) Filed: Jan. 18, 2008

(65) Prior Publication Data

US 2008/0173481 A1 Jul. 24, 2008

Related U.S. Application Data

(60) Provisional application No. 60/885,761, filed on Jan. 19, 2007, provisional application No. 60/885,800, filed on Jan. 19, 2007, provisional application No. 60/885,828, filed on Jan. 19, 2007, provisional application No. 60/885,839, filed on Jan. 19, 2007.

(51) Int. Cl.
*E21B 10/62* (2006.01)

(52) U.S. Cl. ..... 175/262; 175/283

(58) Field of Classification Search ..... 175/40, 175/50, 51, 57, 262, 283, 305, 325
See application file for complete search history.

(56) References Cited

U.S. PATENT DOCUMENTS

| | | | | |
|---|---|---|---|---|
| 2,179,010 | A | 11/1939 | Creighton et al. | |
| 2,284,580 | A | 5/1942 | Kammerer et al. | |
| 3,429,387 | A * | 2/1969 | Brown | 175/237 |
| 3,554,304 | A | 1/1971 | Link et al. | |
| 3,700,049 | A | 10/1972 | Tiraspolsky et al. | |
| 5,244,050 | A * | 9/1993 | Estes | 175/393 |
| 5,351,765 | A | 10/1994 | Ormsby | |
| 5,589,825 | A | 12/1996 | Pomerleau | |
| 6,269,891 | B1 | 8/2001 | Runia | |
| 7,140,454 | B2 | 11/2006 | Runia | |
| 7,549,471 | B2 | 6/2009 | Aivalis et al. | |
| 7,708,057 | B2 | 5/2010 | Aivalis et al. | |
| 2004/0118611 | A1 * | 6/2004 | Runia et al. | 175/57 |
| 2005/0029017 | A1 | 2/2005 | Berkheimer et al. | |
| 2006/0118298 | A1 | 6/2006 | Millar et al. | |
| 2008/0156477 | A1 | 7/2008 | Aivalis et al. | |
| 2010/0096187 | A1 * | 4/2010 | Storm et al. | 175/50 |

OTHER PUBLICATIONS http://www.merriam-webster.com/.*
Runia, John et al., "Through Bit logging: Applications in Difficult Wells, Offshore North Sea", SPE/IADC 92256, (Feb. 23, 2005), 8 pgs.

(Continued)

*Primary Examiner* — Daniel P Stephenson
(74) *Attorney, Agent, or Firm* — Krueger Iselin LLP

(57) ABSTRACT

Disclosed drilling systems offer multiple methods providing access to the open borehole without first tripping the drill string. In some embodiments, a drill bit has a tool port that is blocked by a plug during normal drilling operations. When a tool is deployed through the interior of the drill string, the tool port opens, enabling the tool to enter the borehole beneath the drill string and perform logging or sampling operations. The plug may be attached to the drill bit by a hinge or pivot, or alternatively, the plug may be discarded and a replacement seated in place after the tool is retracted into the drill string. In other embodiments, the drill bit itself is detachable, allowing the bit to be parked in the hole or in a side bore. If desired, the bit can be re-attached by lowering the drill string to the bottom of the hole.

21 Claims, 17 Drawing Sheets

OTHER PUBLICATIONS

Mahony, James "Through-Bit Technology may Brighten the Outlook for Tough Logging Conditions", New Technology Magazine, (Sep. 2004),3 pgs.

Runia, John et al., "Through Bit Logging: A New Method to Acquire Log Data, and a First Step on the Road to Through Bore Drilling", SPWLA 45th Annual Logging Symposium, (Jun. 6, 2004), 8 pgs.

Runia, John et al., "Technologies Leading Way to New Through-Bit, Through-Bore Capabilities in Well Logging and Drilling", The American Oil & Gas Reporter, adapted from a paper originally prepared for presentation at the Society of Petrophysicists & Well Log Analysts' 45th Annual Symposium, held Jun. 6-9 in The Netherlands, 7 pgs.

* cited by examiner

DRILL BIT CONFIGURATIONS FOR PARKED-BIT OR THROUGH-THE-BIT-LOGGING

CROSS-REFERENCE TO RELATED APPLICATIONS

The present application claims priority to the following U.S. Provisional applications, each of which is hereby incorporated herein by reference:

- U.S. Pat. App. 60/885,761, entitled "Drill Bit with Disposable Insert for Through-Bit Borehole Access" and filed Jan. 19, 2007 by inventor C. Menezes.
- U.S. Pat. App. 60/885,800, entitled "Drill Bit with Hinged Plug for Through-Bit Borehole Access" and filed Jan. 19, 2007 by inventor C. Menezes.
- U.S. Pat. App. 60/885,828, entitled "Drill Bit with Pivoting Plug for Through-Bit Borehole Access" and filed Jan. 19, 2007 by inventor D. Krueger.
- U.S. Pat. App. 60/885,839, entitled "Drill Bit with Disconnect Mechanism and Method for Logging and Drilling a Well" and filed Jan. 19, 2007 by inventor C. Menezes.

BACKGROUND

Modern oil field operations require that the borehole be made accessible to a variety of downhole tools. Operations requiring borehole access include fluid sampling, formation pressure testing, and logging. Logging can be performed by several methods including wireline logging, "logging while drilling" (LWD), and through-the-bit logging.

In wireline logging, a probe or "sonde" is lowered into the borehole after some or the entire well has been drilled and the drillstring extracted. The sonde hangs at the end of a long cable or "wireline" that provides mechanical support to the sonde and also provides an electrical connection between the sonde and electrical equipment located at the surface of the well. In accordance with existing logging techniques, various parameters of the earth's formations are measured and correlated with the position of the sonde in the borehole as the sonde is pulled uphole.

In LWD, the drilling assembly includes sensing instruments that measure various parameters as the formation is being penetrated. While LWD techniques allow more contemporaneous formation measurements, drilling operations create an environment that is generally hostile to electronic instrumentation and sensor operations.

Through-the-bit logging involves introducing a logging instrument into the borehole through a port located in the drill bit. The logging instrument (potentially a wireline tool) is lowered or pumped into the borehole through the interior passage of the drill string. At the lower end of the drill string, a port in the drill bit allows the logging instrument to pass into the borehole. Wireline tools may be used to perform logging below the drill bit, or the logging tool may be suspended from the drill string. For example, logging may be performed as the drill string is removed from the borehole ("logging while tripping"). Through-the-bit logging allows examination of the borehole in a relatively benign environment without first extracting the drillstring from the borehole, and accordingly may offer potential advantages over both wireline logging and LWD. Avoiding the harsh drilling environment of LWD potentially results in improved data quality, and a decrease in tool failures and the associated costs. The ability to log the formation when desired, without needlessly tripping the drillstring out of the hole, may result in substantial time savings when compared to conventional wireline logging.

Conventional drilling operations employ drill bits with nozzles that spray drilling fluid at high pressure to clear cuttings from the bit and from the bottom of the hole. The nozzles may not be large enough to serve as a tool port, whereas a tool port of sufficient size for through-the-bit logging may prevent effective clearing of cuttings.

BRIEF DESCRIPTION OF THE DRAWINGS

In the following detailed description, reference will be made to the accompanying drawings, in which.

The drawings show illustrative embodiments that will be described in detail. However, the description and accompanying drawings are not intended to limit the claimed invention to the illustrative embodiments, but to the contrary, the intention is to disclose and protect all modifications, equivalents, and alternatives falling within the spirit and scope of the appended claims.

DETAILED DESCRIPTION

Disclosed herein are various alternative drill bit configurations and through-the-bit logging methods. The disclosed configurations and methods are expected to ease logging tool size restrictions without in any way compromising drill bit performance. Some configurations offer replaceable tool port plugs which can be discarded for through-bit logging operations. Other configurations offer hinged or rotating port covers that can be closed for further drilling operations after through-the-bit logging has been performed. Yet other configurations allow the drill bit to be temporarily "parked" and later recovered after logging operations are complete. Each of these configurations and their associated methods are described in detail below.

Figure 1A:
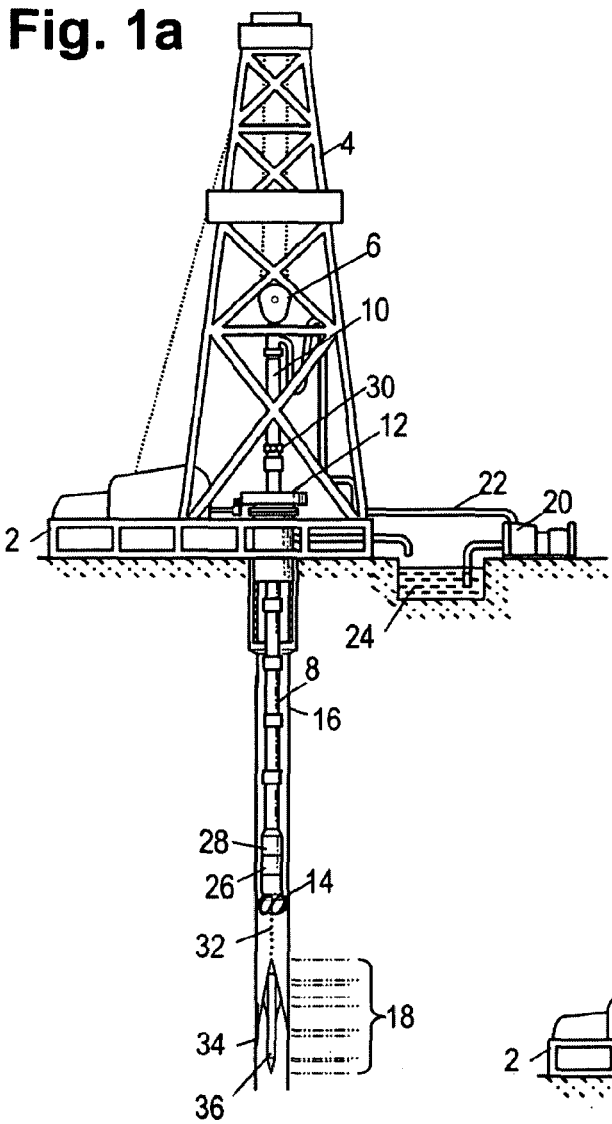
FIG. 1*a* shows an illustrative through-the-bit logging environment.
Figure 1B:
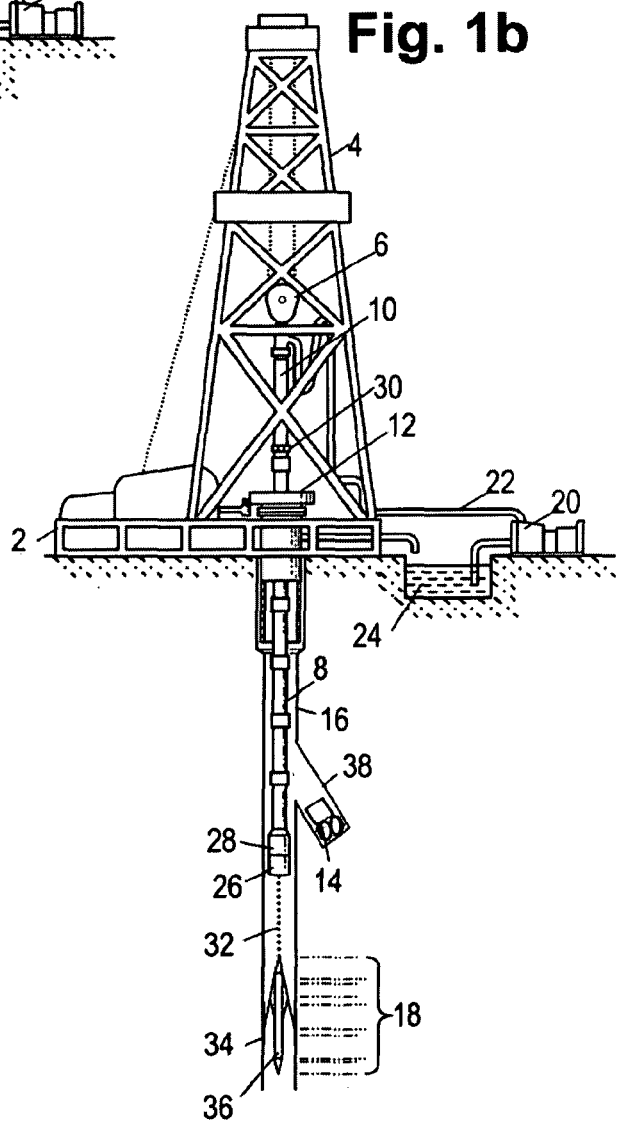
FIG. 1*b* shows an illustrative parked-bit logging environment.

The disclosed configurations and methods are best understood as part of a larger context as shown in FIGS. 1*a*-1*b*. FIG. 1*a* shows an illustrative through-the-bit logging environment. A drilling platform 2 supports a derrick 4 having a traveling block 6 for raising and lowering a drill string 8. A kelly 10 supports the drill string 8 as it is lowered through a rotary table 12. A drill bit 14 is driven by a downhole motor and/or rotation of the drill string 8. As bit 14 rotates, it creates a borehole 16 that passes through various formations 18. A pump 20 circulates drilling fluid through a feed pipe 22 to kelly 10, downhole through the interior passage of drill string 8, through orifices in drill bit 14, back to the surface via the annulus around drill string 8, and into a retention pit 24. The drilling fluid transports cuttings from the borehole into the pit 24 and aids in maintaining the borehole integrity.

FIG. 1*a* also shows a logging tool adapted for through-the-bit use 36. With the drill string 8 raised off the bottom of the borehole 16, the logging tool 36 is inserted into the drill string 8 at the surface and lowered through the interior of the drill string to the drill bit 14 and beyond into the open borehole. A slickline or wireline cable 32 is used to raise and lower the logging tool 8. (The cable 32 may enter the interior of the drill string via a port on the kelly 10 or a special-purpose sub.) A slickline cable provides only mechanical support, while a wireline cable 32 provides power to the tool and allows the tool to communicate with systems located on the surface. Some alternative tool embodiments are powered by internal sources in addition to or in lieu of being powered through the cable. Some tool embodiments may store data internally for extraction after removal from the borehole, in addition to, or in lieu of transmitting data to surface systems.

The flow of the drilling fluid may also aid in lowering the tool 8 through drill string 8, drill collar 26 and into drill bit 14. Once the logging tool 8 reaches the drill bit 14, a tool port in the drill bit opens, enabling the tool 36 to pass out of drill bit 14 and enter the borehole 16. Once in the borehole, the tool 36 performs the required operations e.g. collection of formation data such as resistivity, porosity, density, or collection of formation fluid samples etc. In FIG. 1*a*, the dimensions of the tool port are sufficient to enable passage of a the logging tool 36 having centralizer arms with sensing pads 34 that contact the wall of borehole 16 to obtain measurements of various borehole wall attributes as the tool traverses the formations 18 exposed by the borehole.

The tool 36 may be raised or lowered by cable 32 to investigate the area of interest below drill bit 14. Alternatively, the tool 36 seats in the drill bit port and logging is performed as drill string 8 is extracted from the borehole 16, saving the time associated with performing a wireline logging operation after completely removing the drill string 8 from the borehole 16. Thus in some embodiments, the tool 36 may remain partially within the drill bit 14, and may extend from the drill bit 14 only as far as is necessary to perform its intended function. In those embodiments, the tool is moved through the borehole by movement of drill string 8, for example, performing a logging operation while tripping the drillstring out of the borehole. Some tool embodiments may be moved through the drillstring and seated in the bit by fluid flow without reliance on a supporting cable 32.

FIG. 1*b* shows an illustrative parked-bit logging environment, which is similar to the through-the-bit logging environment of FIG. 1*a*. However, rather than providing a port in the drill bit 14, the parked-bit logging system disconnects the drill bit entirely. The drill bit 14 may be parked at the bottom of the borehole 16 or parked in a side borehole 38. In FIG. 1*b*, drilling operations have been suspended, and drill bit 14 has been detached from the drillstring 8 and parked in a side borehole 38. With the drill string 8 raised up off the bottom of the borehole 16, the logging tool is inserted into the drill string 8 at the surface and lowered through the interior of the drill string 8, through the drill collar 26, and out into the open borehole. Cable 32 provides mechanical support to logging tool 36, and may further supply power and telemetry communications channels that enable the tool to communicate with surface facilities. Once logging is complete, the logging tool 36 may be withdrawn back through the drill string to the surface and the drill string 8 may optionally reconnect with the drill string for further drilling operations.

In some embodiments, the tool 36 may remain partially within the drillstring 8, and extend from the drillstring 8 only as far as is necessary to perform its intended function. In those embodiments, the tool is moved through the borehole by movement of drill string 8. For example, logging can be performed while tripping the drillstring out of the borehole. Some alternative tool embodiments are powered by internal sources in addition to or in lieu of being powered through the cable. Some tool embodiments may store data internally for extraction after removal from the borehole, in addition to, or in lieu of transmitting data to surface systems. Some tool embodiments may be moved through the drillstring by fluid flow in addition to or in lieu of a connecting cable.

Figure 2:
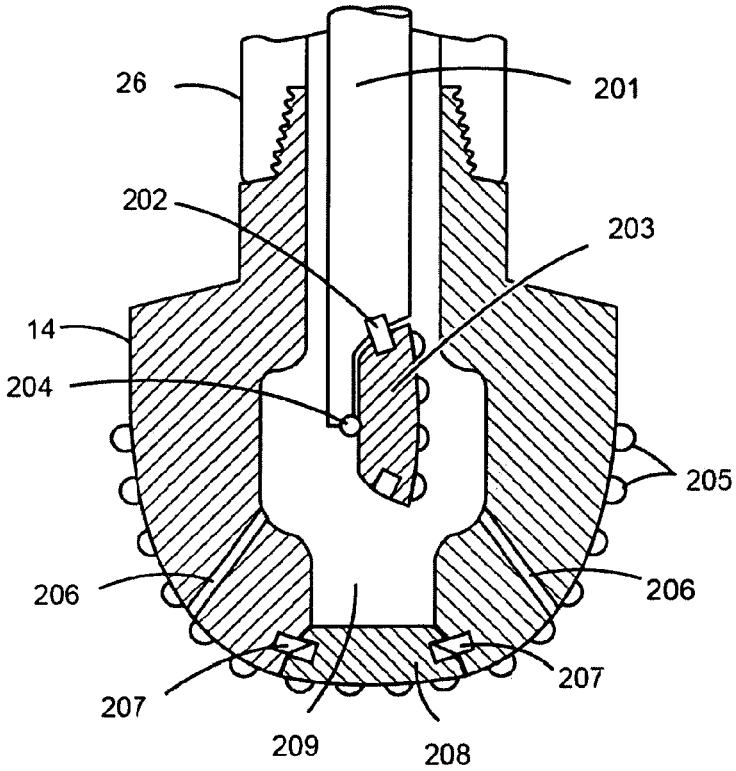
FIG. 2 shows a first illustrative bit configuration for through-the-bit logging.

FIG. 2 shows a longitudinal cross-section of an illustrative drill bit embodiment adapted for through-the-bit tool use. The drill bit 14 couples to the drill string 8 via a drill collar 26. The drill bit 14 has cutting surfaces 205 for removing rock from the bottom of the borehole. Drilling fluid flows through the interior passage of the drill string and into the drill bit 14 before exiting the drill bit 14 through the provided nozzles 206 to clean cuttings from the drill bit 14 and the borehole bottom. The bottom of drill bit 14 includes a port 209 through which a suitable tool 201 may pass to gain access to the borehole beyond the drill bit 14. The port 209 includes a plug 208 that blocks port 209 and allows the drill bit 14 to engage in normal drilling operations. Plug 208 is retained in bit 14 by latching mechanism 207. For purposes of illustration, only two latching points are shown, however, one or more latching points may be employed. Latching mechanisms 207 suitable for retaining plug 208 in tool port 209 of drill bit 14 are well known to those skilled in the art, and may, for instance, be of the type described in U.S. Pat. No. 6,269,891, which is hereby incorporated herein by reference. In other embodiments latching mechanism 207 may be a mechanical latching mechanism with a spring bias. In another embodiment latching mechanism 207 may be an electromagnetic latching mechanism such that a magnetic field causes a bolt to latch or unlatch the plug 208. As yet another illustrative embodiment, tool 201 may include power connections that couple to corresponding connections in the drill bit to operate the latching mechanism. Retaining plug 208 may be disposable.

Figure 3:
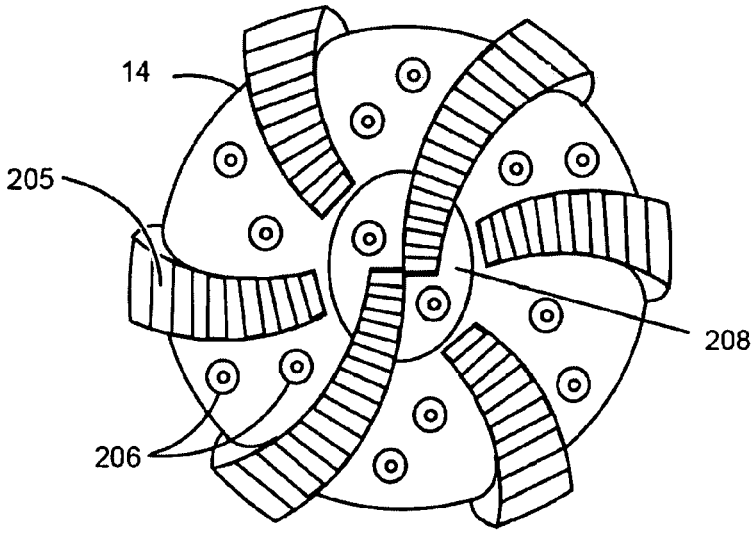
FIG. 3 shows a bottom view of the first illustrative bit configuration.

FIG. 3 shows a bottom exterior view of drill bit 14. In this embodiment plug 208 and the corresponding opening of port 209 are elliptical in shape. As will be discussed further below, the elliptical shape of plug 208 and the corresponding opening of tool port 209 may advantageously help to properly orient a replacement plug 203 as said plug is scating in port 209. Moreover, such an elliptical shape inhibits rotation of plug 208 during drilling operations. In some embodiments, plug and port openings may take other irregular shapes to achieve similar advantages.

Figure 4:
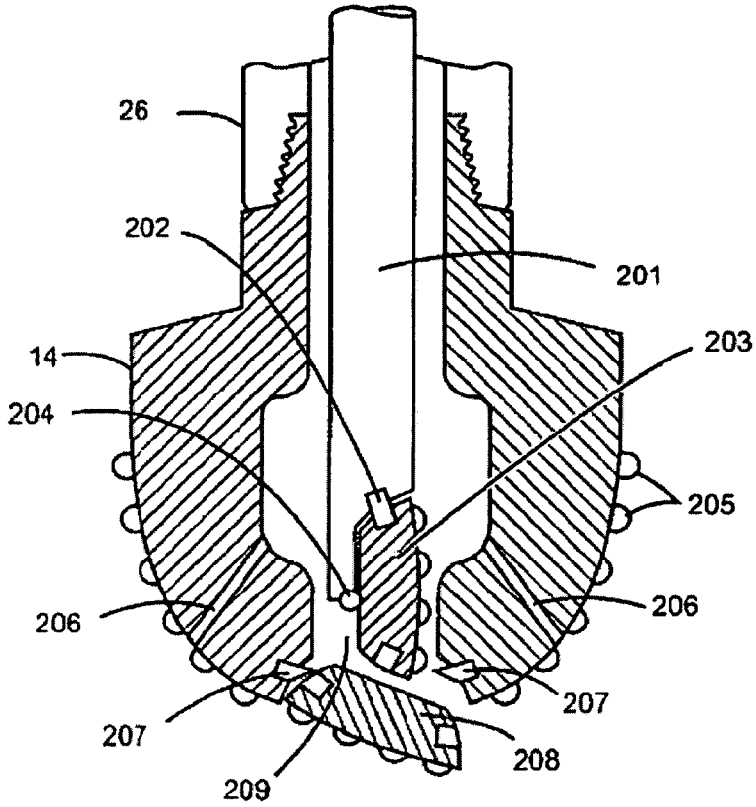
FIGS. 4-6 show a logging tool being deployed through the bit.

Referring back to FIG. 2, FIG. 2 also shows a tool 201 adapted for use in through-the-bit operations. The tool enters the bit through the drill string fluid passage. FIG. 4 shows that, as tool 201 enters port 209 of drill bit 14, the latching mechanisms 207 retaining plug 208 in port 209 of drill bit 14 are disengaged. In some embodiments, latching mechanisms 207 are disengaged by the tool's action on the bit as it passes through port 209 and approaches the plug. Spring-loaded trigger mechanisms or electromagnetic latches may disengage the latches. In other embodiments, latching mechanisms 207 are disengaged when tool 201 depresses a disconnect switch on plug 208.

Figure 5:
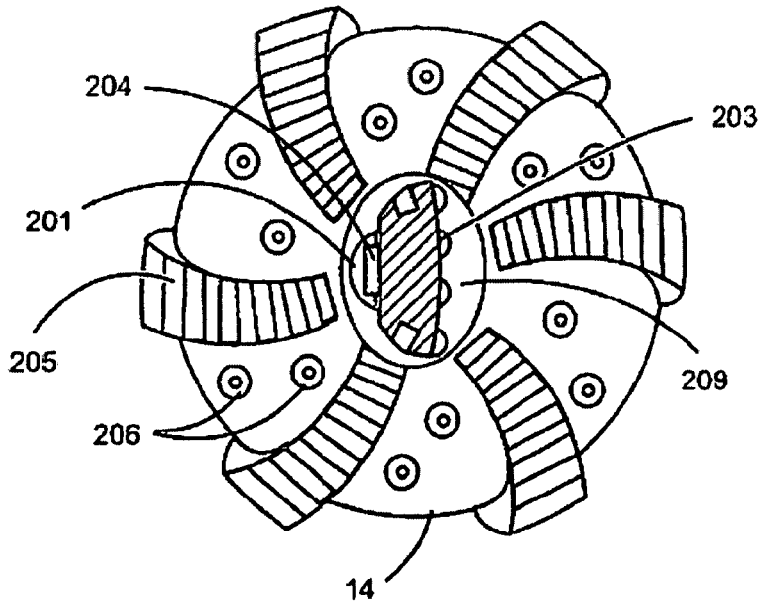

In the embodiment illustrated, the tool includes a replacement plug 203 that may be used to replace the plug 208 in port 209 after plug 208 is removed from drill bit 14 and discarded. FIG. 5 illustrates tool 201 and replacement plug 203 passing through port 209 of bit 14 after plug 208 has been unlatched. Elliptical replacement plug 203, as conveyed by tool 201, is oriented longitudinally with respect to tool 201. This orientation is advantageous because it allows the replacement plug 203 and the conveying tool 201 to pass through the elliptical opening of port 209 when tool 201 and plug 203 are properly oriented with respect to port opening 209. (The proper orientation may be secured in a number of ways, including the alignment mechanisms disclosed in U.S. Pat. No. 6,269,891.) As illustrated, when the short side of elliptical replacement plug 203 is substantially aligned with the long side of the elliptical opening of port 209, tool 201 and replacement plug 208 are able to pass through port 209 into the borehole 16.

Figure 6:
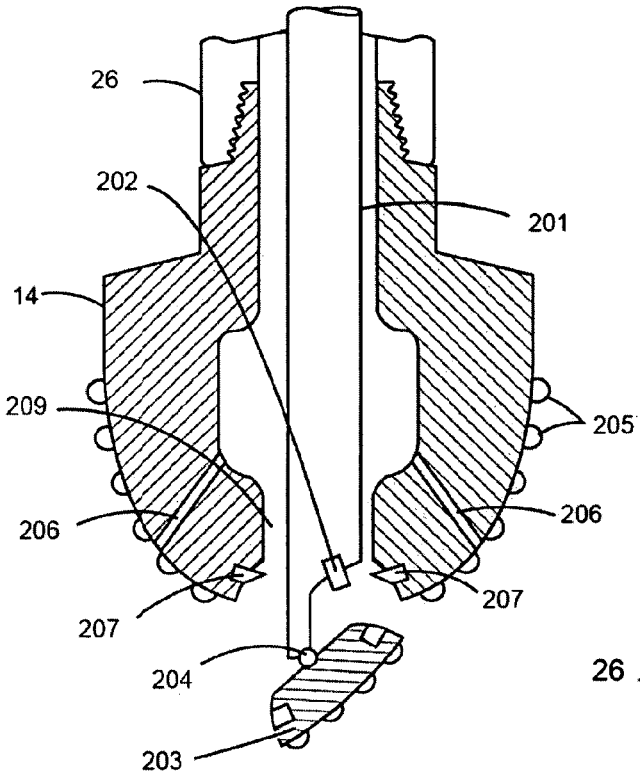

FIG. 6 shows the tool 201 and replacement plug 203 emerging from bit 14 through port 209. Replacement plug 203 is attached to tool 201 by latching retainer 202 and swiveling retainer 204. Latching retainer 202 may be, for example, an electromagnetic device that retracts a bolt or other retaining structure into the tool to enable replacement plug 203 to swivel on swiveling retainer 204 in preparation for placement of replacement plug 203 in port 209 of drill bit 14. After tool 201 and replacement plug 209 have entered borehole 16, and are clear of bit 14, the tool 201 may disengage retainer 202 allowing replacement plug 209 to rotate on swiveling retainer 204 into a position substantially perpendicular to tool 201, as shown in FIG. 7.

Figure 7:
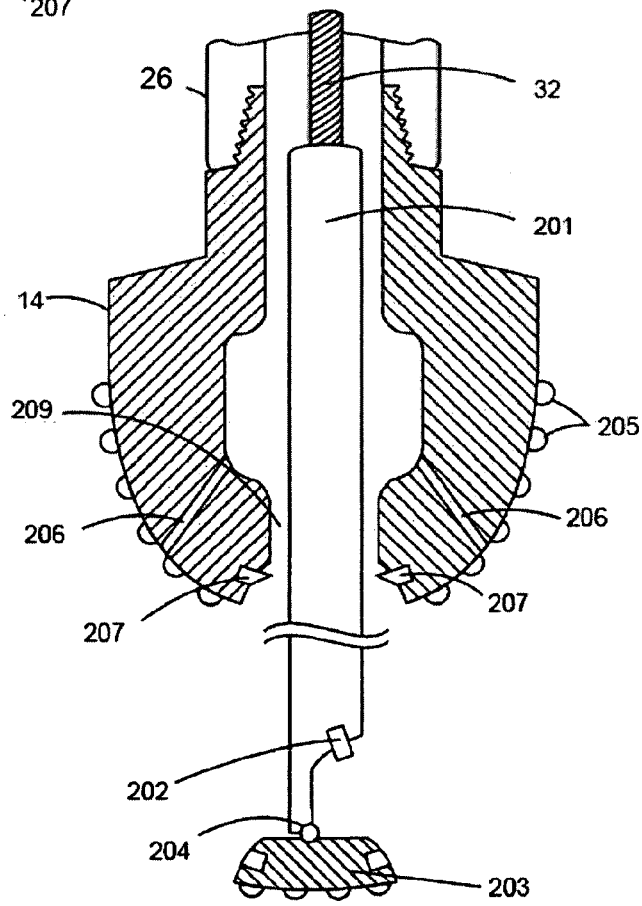
FIGS. 7-8 show replacement of the port insert in the first illustrative bit configuration.

FIG. 7 shows tool 201 largely outside of drill bit 14 in borehole 16. Tool 201 is substantially positioned to perform its intended function whether that be logging of borehole 16 or any other tool function adapted for through-the-bit use. For example, tool 201 may be a resistivity tool, a porosity tool, a density tool, an acoustic tool, a coring tool, a sampling tool, a downhole camera, or any combination thereof. These and other tools are commercially available and can be readily adapted for the applications disclosed herein.

Replacement plug 203 is substantially perpendicular to tool 201, having rotated down on swiveling retainer 204. This position enables replacement plug 203 to engage in port 209 when tool 201 is retracted into bit 14. The beveled mating surfaces of replacement plug 203 and the opening of port 209, in conjunction with swiveling retainer 204, enable replacement plug 203 to align itself with port 209 as tool 201 is retracted into bit 14.

Figure 8:
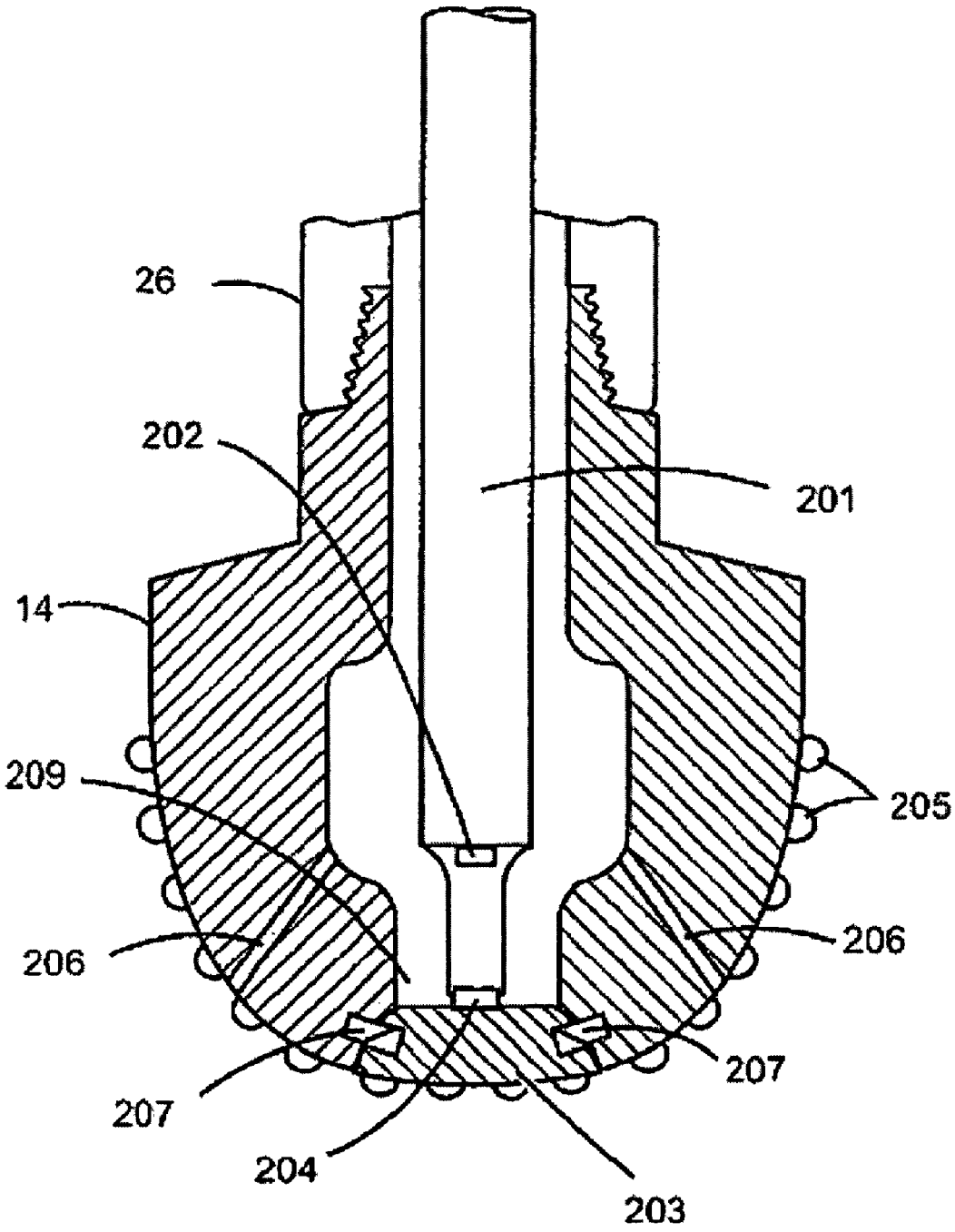

FIG. 8 shows tool 201 retracted into bit 14. Replacement plug 203 moves in the opening of port 209 and is latched into place by latching mechanisms 207. When tool 201 and plug 203 passed out of bit 14 into borehole 16, the short dimension of elliptical plug 203 was substantially aligned with the long dimension of the elliptical opening of tool port 209. To facilitate the mating of replacement plug 203 with tool port 209, tool 201 rotates to align the long dimension of elliptical plug 203 with the long dimension of the elliptical opening of port 209. The tool 201 and plug 203 may be rotated into alignment by mechanical guides (not shown) built into the interior of drill bit 16 that engage and align tool 201 as tool 201 is retracted in to bit 16. After plug 203 is latched into port 209, tool 201 disengages swiveling retainer 204 allowing tool 201 to retreat into the drillstring. In some embodiments, swiveling retainer 204 is disengaged from plug 203 by breaking a pin in retainer 204, said pin being designed to break when plug 203 is latched into port 209 and sufficient force is applied through cable 701. In other embodiments, retainer 204 may be released by electromechanically moving a structure controlled by tool 201, said structure disengaging retainer 204.

To sum up, FIGS. 2-8 show an illustrative through-the-bit tool system that includes a drill bit incorporating a disposable tool port plug. The disposable plug is latched into the body of the drill bit for normal drilling operations. As a through-the-bit tool moves through the drill string into the bit's tool port, the retaining latches disengage and the plug drops from the tool port. With removal of the plug, the through-the-bit tool advances through the bit's tool port and at least partially extends into the borehole. In some embodiments, the through-the-bit tool includes a replacement plug, and installs the replacement plug into the bit's tool port as the through-the-bit tool is retracted into the drill string.

Figure 9:
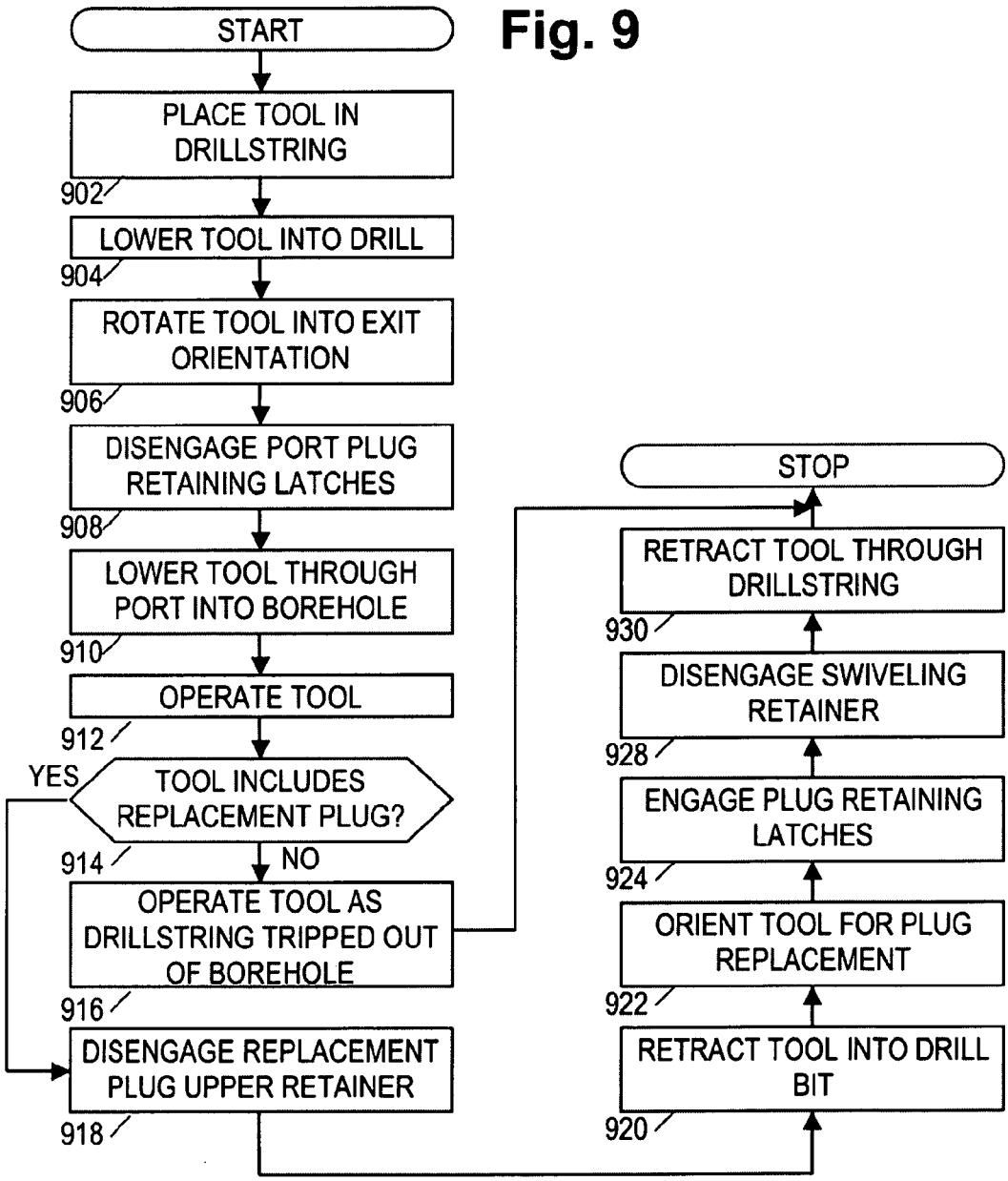
FIG. 9 shows a flow diagram of a first illustrative through-the-bit logging method.

FIG. 9 shows a flow diagram of an illustrative through-the-bit tool operating method, which can be applied after the tool has been raised off the bottom of the borehole. In block 902, the tool is placed in the interior of the drill string at the top of the borehole, optionally supported by a cable. In block 904, the tool descends through the drill string, possibly aided by the flow of drilling fluid and a connected cable. The tool traverses the drill string, eventually passing through the drill collar and entering the drill bit. In block 906, guides internal to the drill string rotate the tool as it prepares to pass through the tool port in the drill bit. The tool and accompanying replacement plug are oriented such that the face of the tool borne replacement plug is substantially parallel to the long side of the drill bit's elliptical tool port. This orientation allows clearance for the tool and replacement plug to pass through the tool port and into the borehole.

In block 908, the latches retaining the plug in the drill bit's tool port are disengaged, freeing the plug to drop away from the bit. The latching mechanisms may be disengaged by tool contact with a release mechanism as the tool enters the tool port, or by tool contact with the plug. Suitable latching mechanisms and the associated release mechanisms are well known in the art. In block 910, the tool passes through the bit's tool port and into the borehole.

In block 912, at least some portion of the tool is in the borehole beyond the drill bit and is able to operate as designed. Illustrative tool operations include fluid sampling, formation pressure testing, and logging. If the tool is a logging tool, the tool deploys its sensors and begins making measurements indicative of the formations traversed by the borehole. If a cable is coupled to the tool, the tool may be raised or lowered in the borehole by extending and retracting the cable while the drill string remains stationary. In cases where no cable is coupled to the tool, the tool may be seated in the tool port and the tool's location in the borehole changed by raising or lowering the drill string. In some cases the tool may be used without an accompanying replacement plug, as indicated in block 914. This may be desirable when the drill string must be extracted from the borehole, for instance to replace the drill bit. In block 916, the tools designed for such situations are operated as the drill string is tripped out of the borehole.

When the tool includes a replacement plug, the tool releases its upper plug retainer in block 918, enabling the plug to rotate into a position facilitating the plug's placement in the drill bit's tool port when the tool is retracted. Although this operation is shown as occurring after tool operations are complete, it may occur at other times, including the time immediately after the tool passes through the tool port. The sequence in FIG. 9 is merely illustrative of some possible method.

In block 920, the tool is retracted into the drill string. Retraction may be accomplished by pulling the tool back into the drillstring using the cable coupled to the tool. During retraction, guides within the drill collar may rotate the tool in block 922 to properly orient the replacement plug. The guides preferably align the long dimensions of the elliptical port opening and the elliptical replacement plug, but some deviation from the ideal alignment is acceptable as the beveled mating surfaces of the plug and port opening aid in bringing the plug into alignment.

In block 924, the replacement plug comes into position in the drill bit's tool port. The port retaining latches engage, securing the plug in the bit. The tool continues to retract into the drill string causing the swiveling retainer, attaching the plug to the tool, to disengage in block 928. With the plug detached from the tool, the tool is retracted through the drill string to the surface in block 930.

Figure 10:
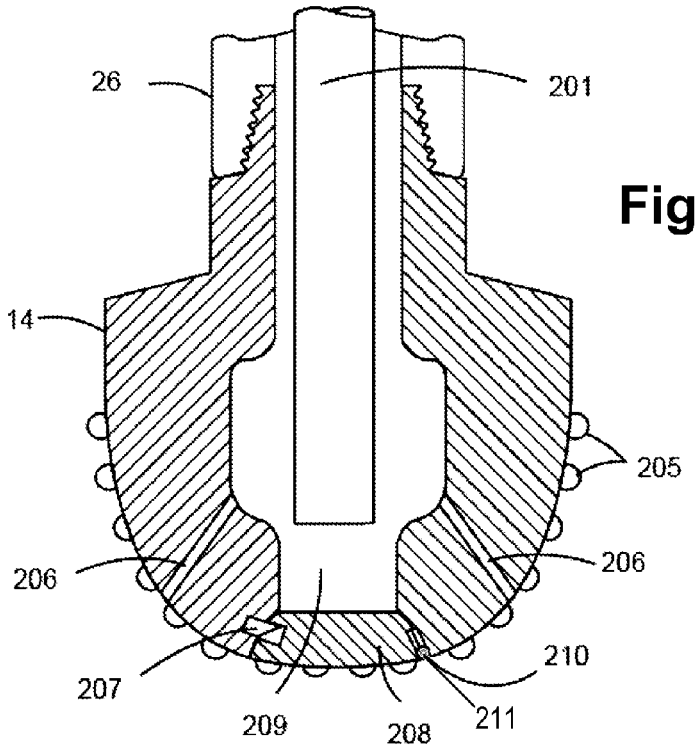
FIG. 10 shows a second illustrative bit configuration for through-the-bit logging.

Other system configurations for through-bit logging are also contemplated, including a hinged-plug bit configuration. FIG. 10 shows a longitudinal cross-section of one such drill bit embodiment. As with the embodiment of FIG. 2, the drill bit 14 has cutting surfaces 205 and nozzles 206. The bottom of drill bit 14 includes a port 209 through which a suitable tool 201 may pass to gain access to the borehole beyond the drill bit 14. The port 209 includes a plug 208 that blocks port 209 and enables the drill bit 14 to engage in normal drilling operations. Plug 208 is retained in bit 14 by a latching mechanism 207 and a hinge 210. For purposes of illustration, only one latching point is shown, however, additional latching points may be employed. As with the embodiment of FIG. 2, the latching mechanism 207 may be (e.g.) a mechanical latching mechanism, an electromagnetic latching mechanism, or a powered latching mechanism.

In this embodiment of a drill bit adapted for use in through-the-bit operations, the plug 208 filling tool port 209 is a hinged plug. The hinge enables the tool port to open and close, and further enables port plug 208 to remain attached to bit 14 when tool port 209 is open. In some embodiments hinge 210 may be an interior or "hidden" hinge, advantageously protecting hinge 210 when drilling. A variety of known hinge designs, including the Soss type hinge, are adaptable for use as an interior plug hinge. In other embodiments, hinge 210 may be an external hinge positioned behind one of the bit's cutters and possibly aligned with an impact arrestor, enabling the hinge to travel the groove created as the cutter scrapes the bottom of the borehole and thereby protecting the hinge during drilling operations. In one embodiment of the invention, the hinge may incorporate a cutting surface. In other embodiments, the hinge may incorporate an impact arrestor (a protrusion designed to ride in a recently-cut groove to maintain bit position and alignment during the cutting process) and in still other embodiments the hinge may incorporate both the impact arrestor, e.g., at one end, and the cutting surface at the other end.

FIG. 10 also shows a through-bit tool 201 Tool 201 enters bit 14 via the interior of the drill string. The tool may trigger the release of latching mechanisms 207 mechanically, electromagnetically, or via a powered connection. The bottom exterior view of drill bit 14 may appear essentially the same as in the embodiment of FIG. 3, i.e., with an elliptical plug shape, though other plug shapes are made feasible by the presence of the hinge.

Figure 11:
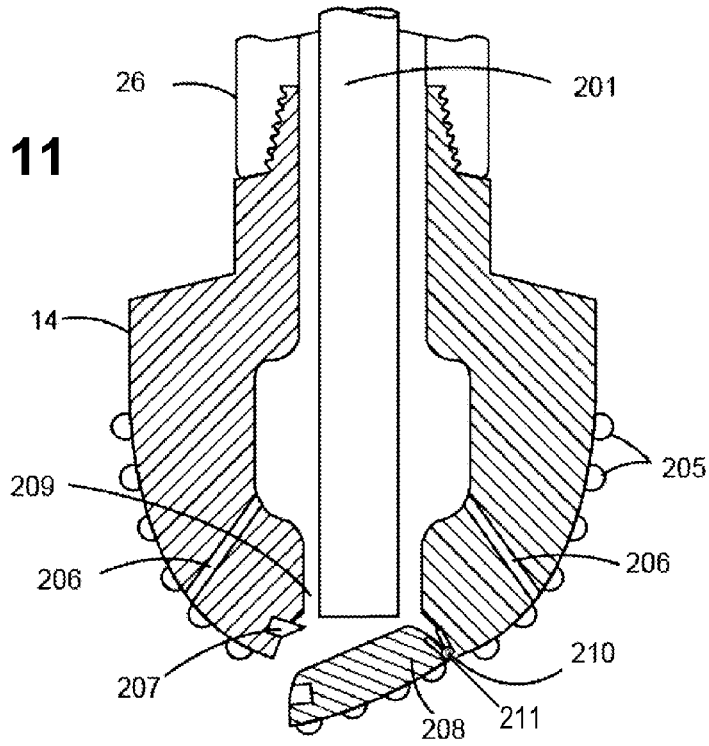
FIGS. 11-13 show a logging tool being deployed through the bit.

FIG. 11 illustrates the interior of drill bit 14 as tool 201 prepares to exit drill bit 14 through port 209. As tool 201 enters port 209 of drill bit 14, it causes the latching mechanism 207 to be disengaged. In some embodiments, latching mechanism 207 is disengaged by the tool's action on the bit as it passes through port 209 and approaches the plug. In other embodiments, latching mechanism 207 is disengaged when tool 201 depresses a disconnect switch on plug 208. Release of latching mechanisms 207, enables plug 208 to swing on hinge 210 as tool 201 proceeds through tool port 209.

Figure 12:
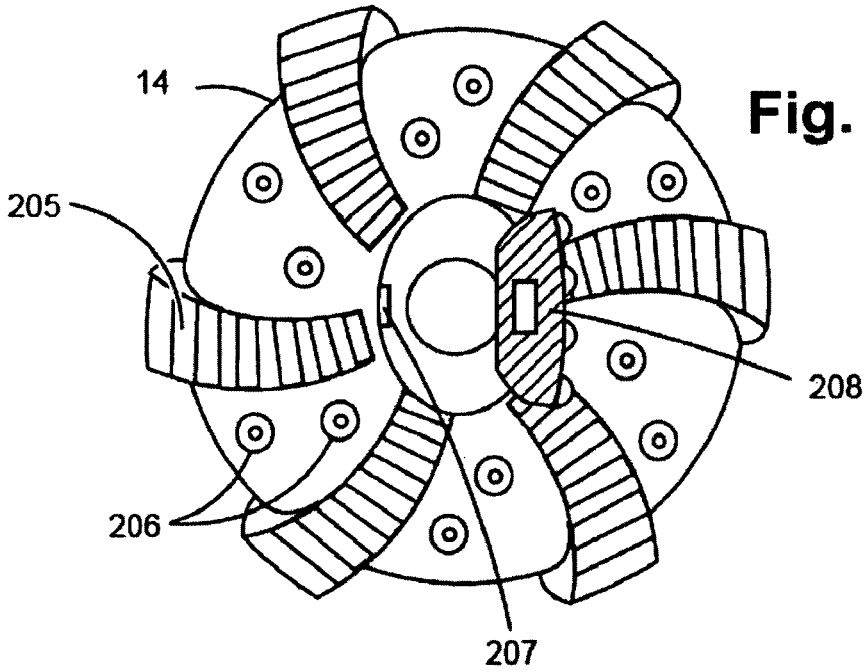
Figure 13:
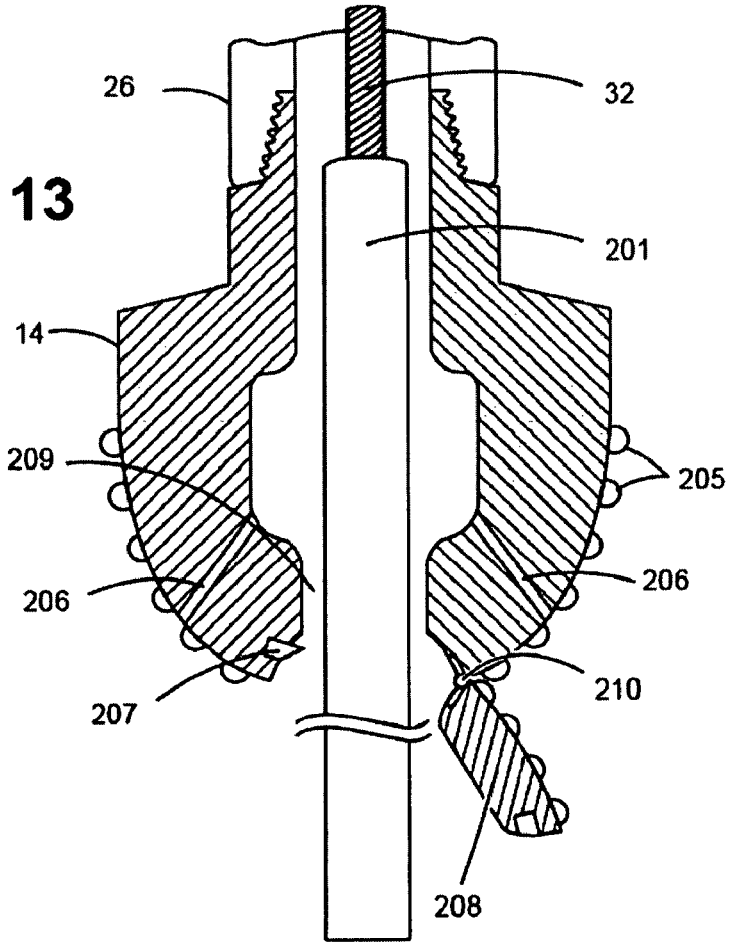

FIG. 12 shows a bottom exterior view of the tool 201 emerging from bit 14 through port 209. As tool 201 passes through tool port 209, plug 208 moves to allow tool passage. FIG. 13 shows tool 201 largely outside of drill bit 14 in borehole 16. Tool 201 is substantially positioned to perform its intended function, whether that function be logging of borehole 16 or any other suitable tool function.

In some embodiments, the hinge 210 includes a biasing spring 211 to return the plug to a closed position as the tool 201 is retracted into the drill string. Alternatively, a hook-type mechanism may be provided on the inside of plug 208 for tool 201 to engage with as it is retracted. As yet another option, plug 208 may be closed by dynamic action of the bit (e.g., downward motion, bit rotation) or momentarily reversed fluid flow after the tool 201 has been retracted. In some spring-biased embodiments, the force applied by the biasing spring is sufficient to latch plug 208 into tool port 209. In other embodiments, latching is accomplished by moving the drill string to the bottom of the borehole.

Figure 14:
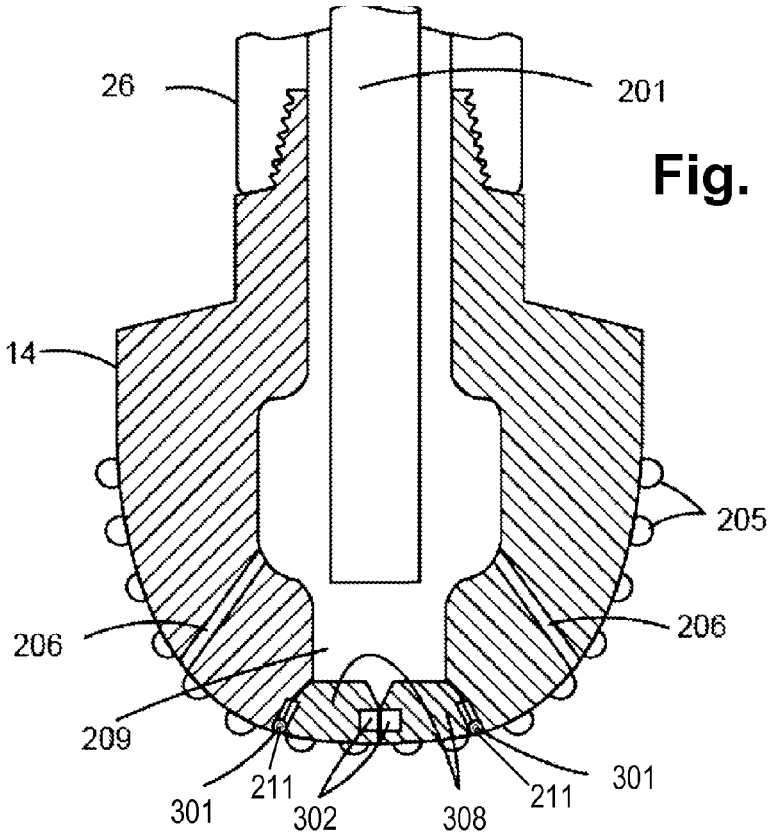
FIG. 14 shows a third illustrative bit configuration for through-the-bit logging.

FIG. 14 shows a longitudinal cross-section of another hinged-plug embodiment. In this embodiment, the plug 908 filling tool port 209 is a hinged plug having two separately hinged sections 308. The hinged plug sections enable tool port 209 to open and close while remaining attached to bit 14 by hinges 301. In some embodiments, hinges 301 may be interior or "hidden" hinges. Alternatively, hinges 301 may be external hinges that are positioned behind the bit's cutters or impact arrestors, thereby placing the hinges in grooves created as the cutters scrape the bottom of the borehole so that the hinges are protected during drilling operations. In the illustrated embodiment, the plug includes two sections 308; however the plug may contain any suitable number of hinged sections. The sections 308 can be provided with latch mechanisms 302 on the edges where they each adjoin the edge of the port 209. (This placement can be most effectively seen in FIG. 17.)

Figure 15:
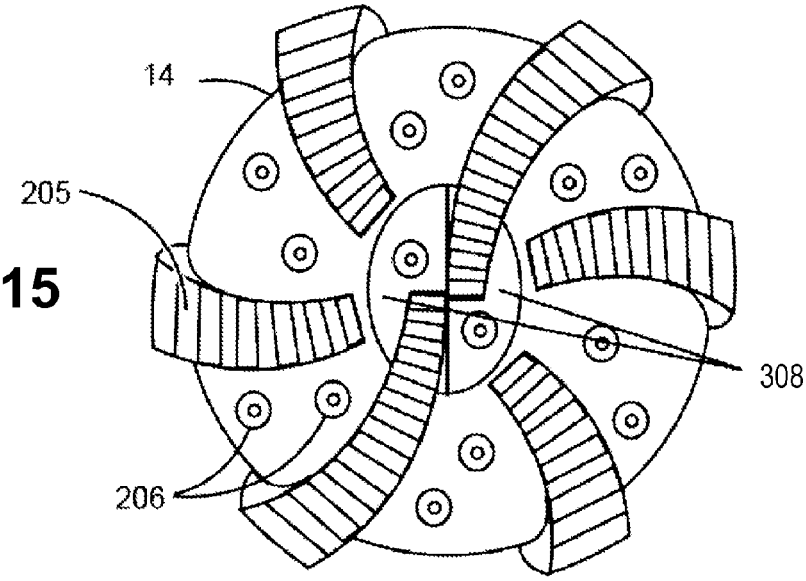
FIG. 15 shows a bottom view of the third illustrative bit configuration.

FIG. 15 shows a bottom exterior view of drill bit 14. In this embodiment plug sections 308 and the corresponding opening of port 209 are elliptical in shape. However, the hinged configuration also makes other opening shapes feasible. The division of the plug into smaller sections 308 may in some cases reduce the stresses on the hinges, thereby reducing risk of hinge failure. Moreover, because the individual sections are smaller, it may be feasible to provide a larger tool port than would be possible in the single hinged-section embodiment.

Figure 16:
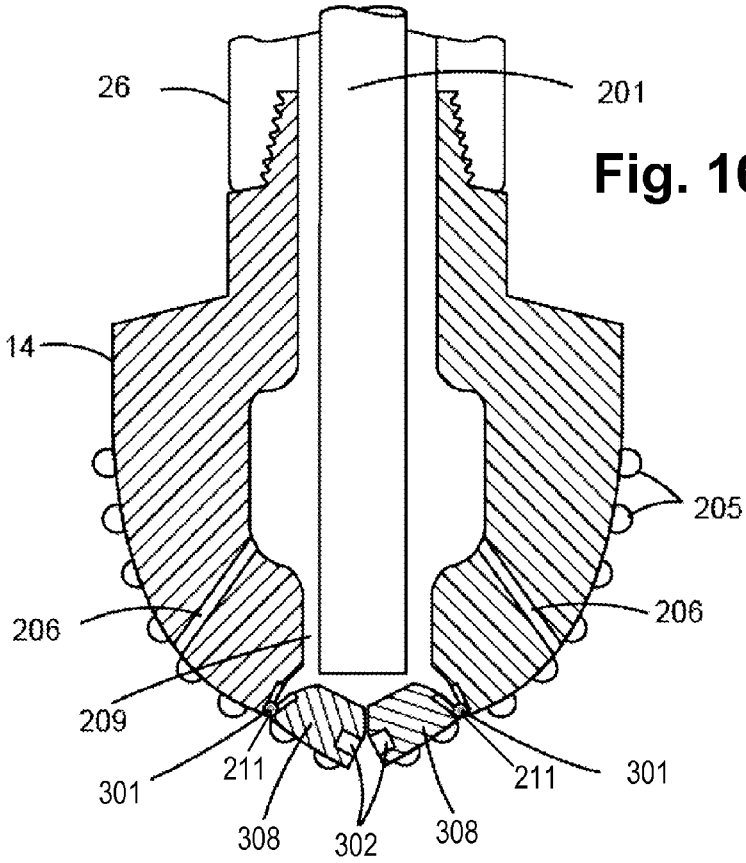
FIGS. 16-17 show a logging tool being deployed through the bit.
Figure 17:
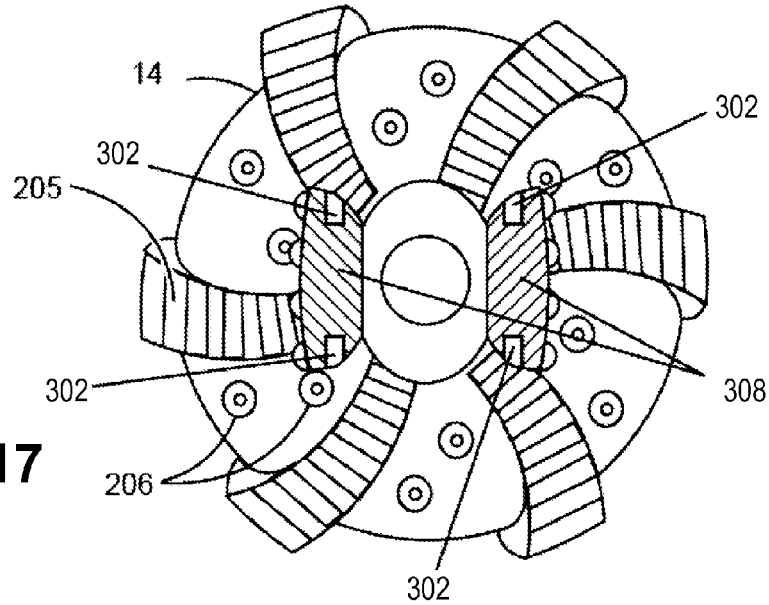

FIG. 16 illustrates the interior of drill bit 14 as tool 201 prepares to exit drill bit 14 through port 209. As tool 201 enters port 209 of drill bit 14, the latching mechanisms 302 retaining plug 908 in port 209 of drill bit 14 are disengaged. In some embodiments, latching mechanisms 302 are disengaged by the tool's action on the bit as it passes through port 209 and approaches the plug. In other embodiments, latching mechanisms 302 are disengaged when tool 201 depresses a release mechanism on plug sections 308. Release of latching mechanisms 902 enables the sections to swing on hinges 301 as tool 201 proceeds through tool port 209. FIG. 17 provides an exterior bottom view that illustrates tool 201 passing through port 209 of bit 14 after plug 908 has been unlatched. With the hinged sections 308 rotated downward, the preferred latch recess locations can be seen on the ends of the sections.

In some embodiments, the hinges 301 include biasing springs 211 to return the plug sections to a closed position as the tool 201 is retracted into the drill string. The force applied by the biasing spring may be sufficient to latch plug sections 308 into tool port 209. Alternatively, latching is accomplished by moving the drill string to the bottom of the borehole and placing weight on the bit. In other embodiments, plug sections 308 are configured to be closed and latched by a reverse fluid flow or by dynamic action of the bit (e.g., downward motion or bit rotation) after the tool 201 has been retracted.

To sum up, FIGS. 10-17 show illustrative through-the-bit tool systems that include a drill bit having hinged tool port plugs. The hinged plugs are latched in a closed position for normal drilling operations. As a through-the-bit tool moves through the drill string into the bit's tool port, the retaining latch(es) disengages and the rotation of the plugs to an open position is thereby enabled. With the hinged plug free to rotate, the tool advances through the bit's tool port and into the borehole. In some embodiments, the hinged tool port plug may be a single piece plug. In other embodiments the hinged tool port plug may be a multiple piece plug. The hinged plugs may be configured to return to a closed position as (or after) the tool is retracted through the tool port.

Figure 18:
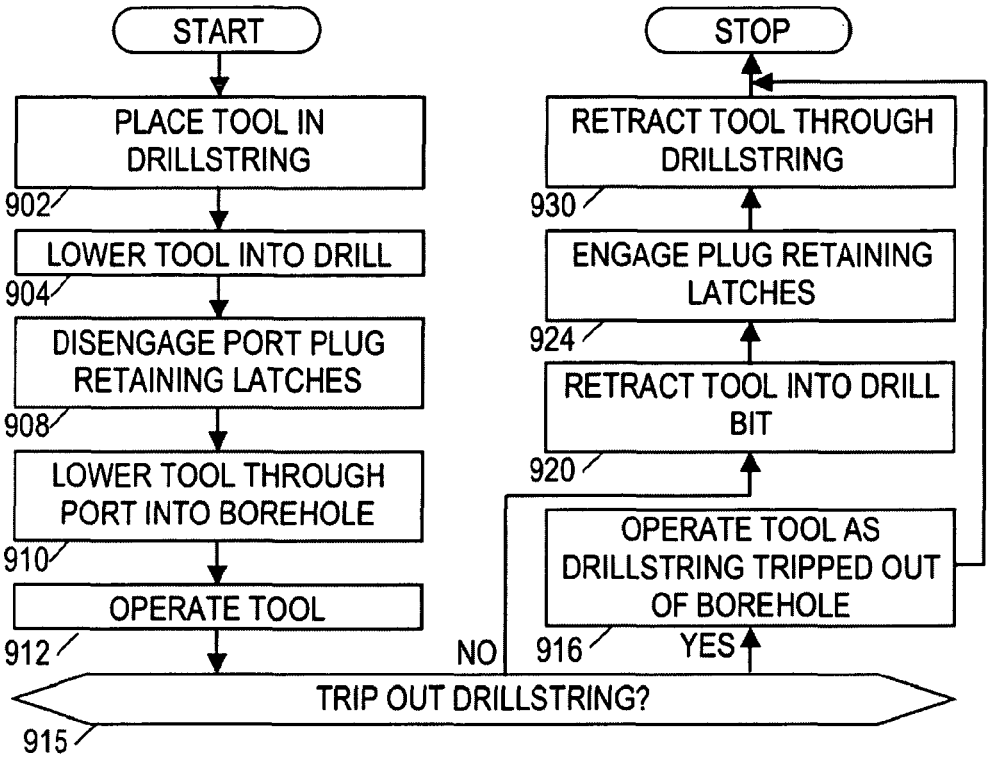
FIG. 18 shows a flow diagram of a second illustrative through-the-bit logging method.

FIG. 18 is a flow diagram of an illustrative through-the-bit tool operating method suitable for use with the hinged-plug bit configurations. It can be applied after the tool has been raised off the bottom of the borehole. Many of the blocks represent operations similar to those shown and FIG. 9 and are numbered correspondingly. In block 902, the tool is placed in the interior of the drill string at the top of the borehole, optionally supported by a cable. In block 904, the tool descends through the drill string, possibly aided by the flow of drilling fluid and a connected cable. The tool traverses the drill string, eventually passing through the drill collar and entering the drill bit and impinging on the tool port. In block 908, the latches retaining the hinged plug in the closed position are disengaged, freeing the plug to rotate about the hinge. The latching mechanism may be disengaged by tool contact with a release mechanism as the tool enters the tool port, or by tool contact with the plug. Suitable latching mechanisms and the associated release mechanisms are well known in the art. In block 910, the tool passes through the bit's tool port and into the borehole.

In block 912, at least some portion of the tool is in the borehole beyond the drill bit and is able to operate as designed. Illustrative tool operations include fluid sampling, formation pressure testing, and logging. If the tool is a logging tool, the tool deploys its sensors and begins making measurements to characterize the formations traversed by the borehole. If a cable is coupled to the tool, the tool may be raised or lowered in the borehole by extending and retracting the cable while the drill string remains stationary. In cases where no cable is coupled to the tool, the tool may be seated in the tool port. Block 915 represents the determination of whether logging is to be performed as the drill string is tripped out of the borehole. If so, then in block 916 the drill string is tripped out of the borehole and the logging tool operates as the drill string is extracted.

Otherwise, in block 920, the tool is retracted into the drill string after the open hole operations are complete. Retraction may be accomplished by pulling the tool back into the drill string using the cable coupled to the tool. In block 924, the hinged plugs return to their closed positions and the plug retaining latches engage, securing the hinged plugs in place. In block 930, the tool continues to be retracted through the drill string to the surface.

Figure 19:
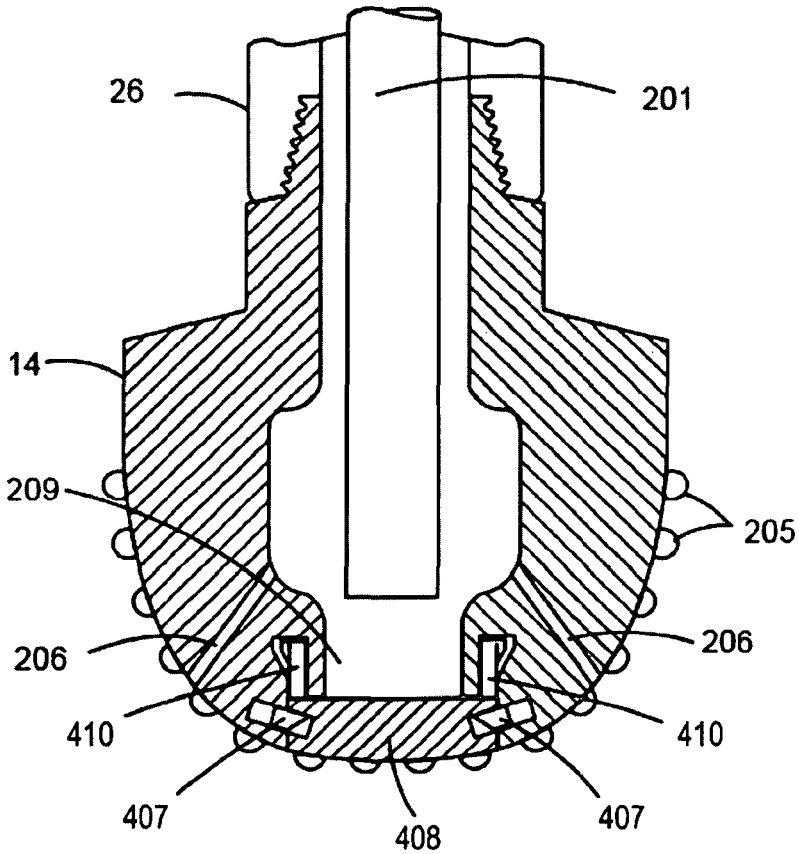
FIG. 19 shows a fourth illustrative bit configuration for through-the-bit logging.

Still other system configurations for through-bit logging are also contemplated, including a pivoting-plug bit configuration. FIG. 19 shows a longitudinal cross-section of one such drill bit embodiment. As with the embodiment of FIG. 2, the drill bit 14 has cutting surfaces 205 and nozzles 206. The bottom of drill bit 14 includes a port 209 through which a suitable tool 201 may pass to gain access to the borehole beyond the drill bit 14. The port 209 includes pivoting plug sections 408 that block port 209 and enable the drill bit 14 to engage in normal drilling operations. Plug 408 is retained in bit 14 by a latching mechanism 407 and a pivot arm 410. For purposes of illustration, two latching points are shown, however, one or more latching points may be employed for each plug section. As with the embodiment of FIG. 2, the latching mechanism 407 may be (e.g.) a mechanical latching mechanism, an electromagnetic latching mechanism, or a powered latching mechanism.

Figure 20:
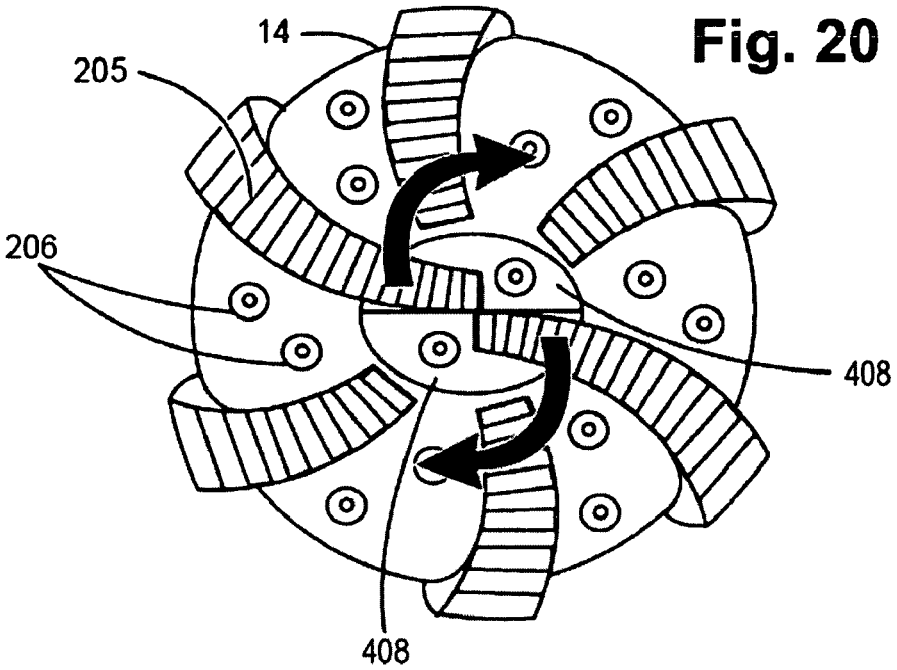
FIG. 20 shows a bottom view of the fourth illustrative bit configuration.

In FIGS. 19 and 20, pivoting plug sections 408 are shown in a closed position. Pivot arm 410 enables each pivoting plug section to move outward from the drill bit face and to rotate 90° as shown in the ensuing figures. A pin or tab provided on each pivot arm rides in a corresponding slot in the socket holding the pivot arm. As the pivot arm moves outward, the slot moves the pin azimuthally on the pivot arm, causing the pivot arm (and the associated plug section) to rotate as the pivot arm approaches the end of its outward travel. When the pivot arm moves inward, the slot moves the pin back to its original position, causing the pivot arm to rotate back into alignment before the plug section is re-seated in the bit face.

Figure 21:
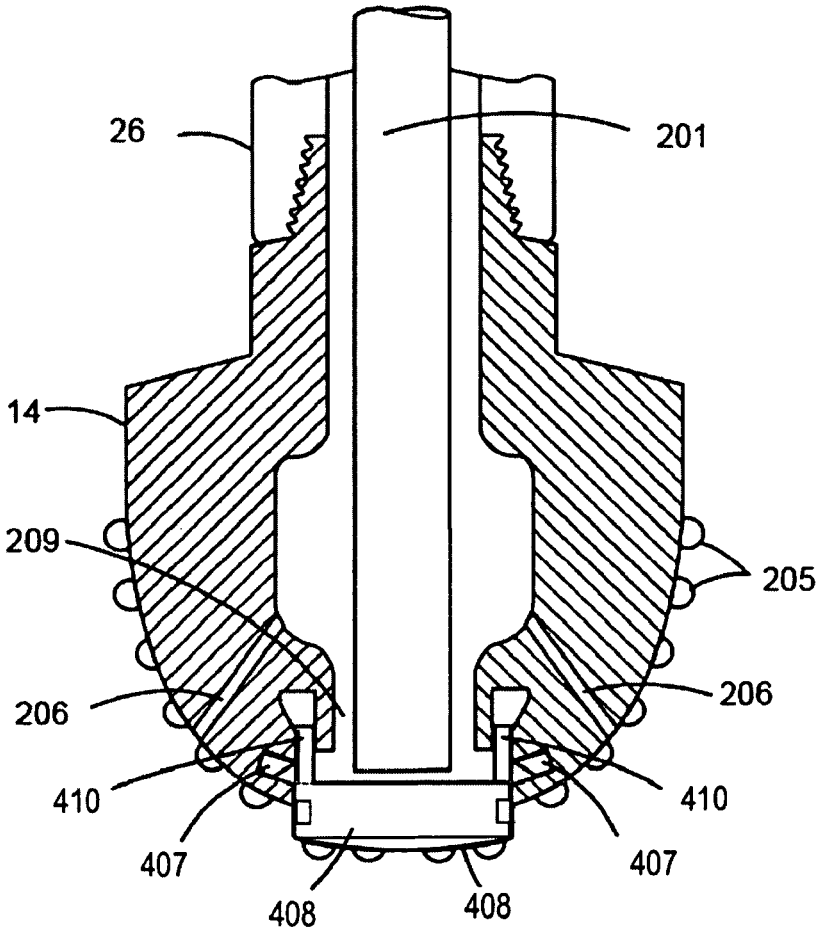
FIGS. 21-23 show a logging tool being deployed through the bit.
Figure 22:
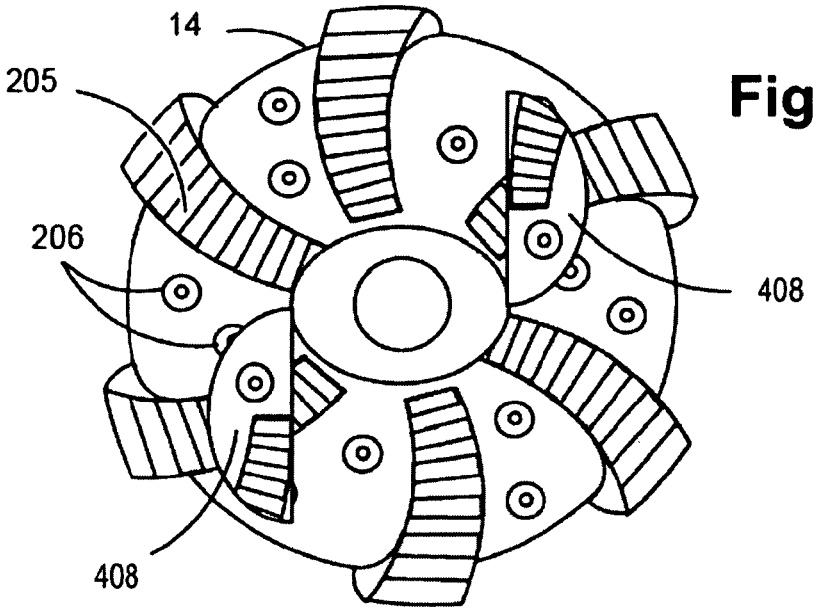
Figure 23:
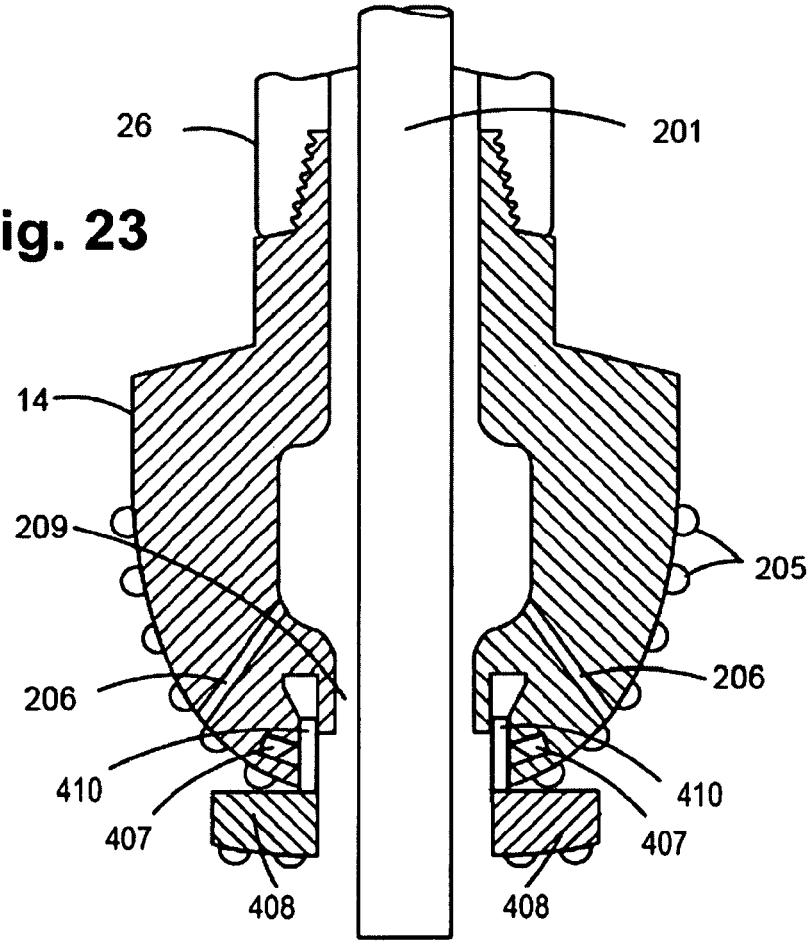

This sequence of events is illustrated beginning with FIG. 20, which shows the plug sections 408 in their original positions an the exterior bottom view of FIG. 20. Arrows are provided to indicate the rotation the sections 408 will experience as they reach their full extension. Before such rotation, however, tool 201 enters the tool port 209 as shown in FIG. 21 and disengages the latching mechanisms 407. In some embodiments, latching mechanisms 407 are disengaged by the tool's action on the bit as it passes through port 209 and approaches the plug. In other embodiments, latching mechanisms 407 are disengaged when tool 201 depresses a release mechanism on plug sections 408. Release of latching mechanisms 407, enables the plug sections 408 to move outwardly from the bit face as shown in FIG. 21. As the plug sections 408 approach the end of their travel, they pivot into the positions shown in FIGS. 22-23, clearing the port 209 for passage of tool 201.

In some embodiments, the pivot arms 410 are provided with biasing springs to return the plug sections to a closed position as the tool 201 is retracted into the drill string. The force applied by the biasing spring may be sufficient to latch plug sections 408 into tool port 209. Alternatively, latching is accomplished by moving the drill string to the bottom of the borehole and placing weight on the bit. In other embodiments, plug sections 408 are closed and latched by a reverse fluid flow or by dynamic action of the bit (e.g., downward motion or bit rotation) after the tool 201 has been retracted.

To sum up, FIGS. 19-23 show an illustrative through-the-bit tool system that includes a drill bit having pivoting port plugs. The plugs may be a single piece or segmented into multiple pivoting sections. The pivoting plug sections are latched in a closed position for normal drilling operations. As a through-the-bit tool moves through the drill string into the bit's tool port, the port's plug retaining latches disengage, thereby enabling the pivoting plug sections to descend and rotate, opening the tool port. With the tool port cleared of the plug, the tool advances into the borehole. In some embodiments the sections of the pivoting tool port plug may be returned to the closed position by bias springs. Some methods for utilizing these bit configurations may be very similar to those illustrated previously.

Figure 24:
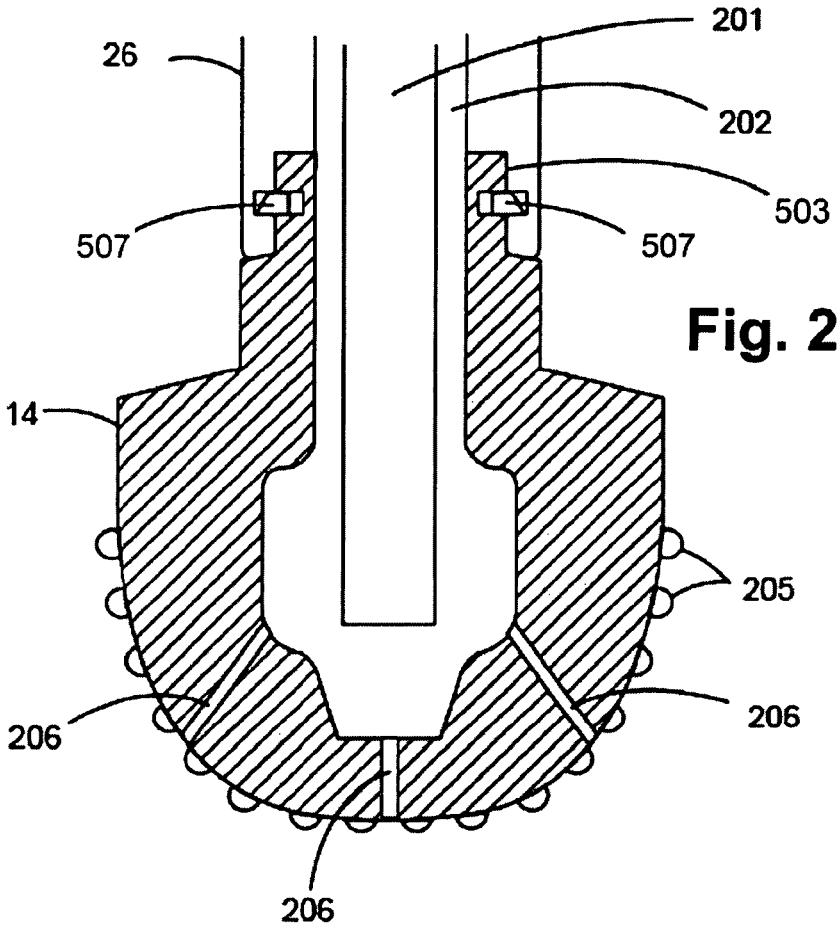
FIG. 24 shows a fifth illustrative bit configuration for parked-bit logging.

In addition to the through-bit logging systems, described above, certain closely-related system configurations are also contemplated, including a parked-bit logging configuration. FIG. 24 shows a longitudinal cross-section of one such drill bit embodiment. As with the embodiment of FIG. 2, the drill bit 14 has cutting surfaces 205 and nozzles 206. However, this configuration does not include a tool port in the bit, but rather it includes a disconnect mechanism 507 that allows the whole bit 14, or at least the gauge portion thereof, to be disconnected, thereby opening a passage for tools to enter the open borehole. (The gauge portion of the bit includes the longitudinally extended portion above the bit face. The bit face is the surface of the bit that contacts the bottom of the borehole during the drilling process and it particularly includes the cutting structures.) Bit 14 is retained in place at the end of drill collar 26 by a shaft 503 and a latching mechanism 507.

Figure 25:
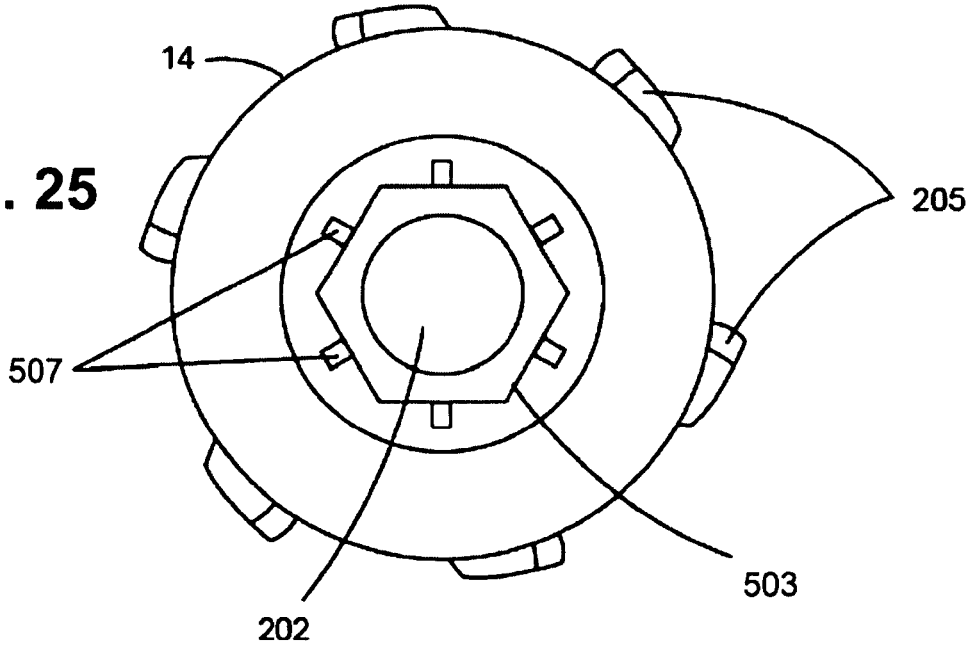
FIG. 25 shows a bottom view of the fifth illustrative bit configuration.

FIG. 25 is an exterior top view of bit 14, showing that shaft 503 has a hexagonal cross-section to efficiently transfer torque from the drill string to the bit. Other embodiments may include other cross-sectional shapes, such as square or octagonal, to couple to the drill collar. Six latching mechanisms 507 are shown as being part of the bit 14, but a greater or lesser number may be employed. In some embodiments, the latching mechanisms are integrated into the collar 26 rather than bit 14. The latching mechanisms 507 may be (e.g.) a mechanical latching mechanism, an electromagnetic latching mechanism, or a powered latching mechanism.

Figure 26:
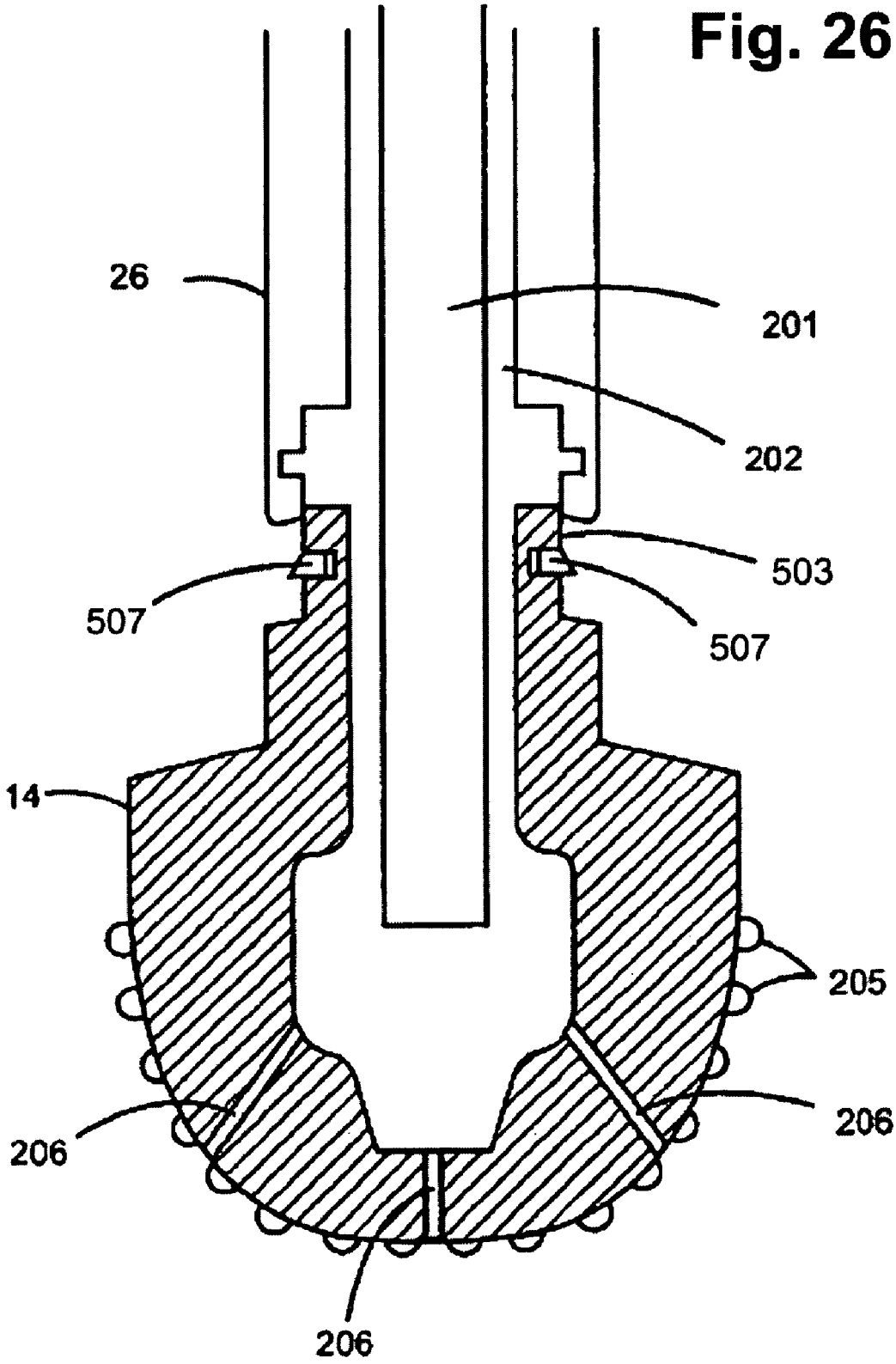
FIGS. 26 and 27*a*-27*c* show deployment of a logging tool for parked-bit logging.
Figure 27C:
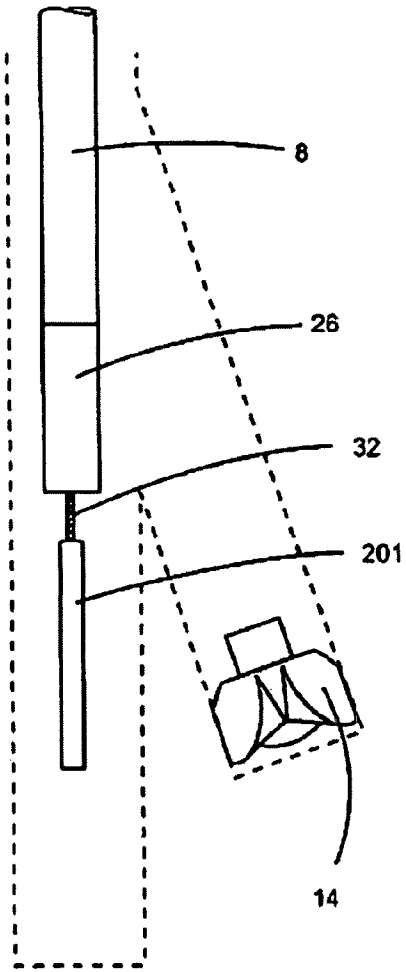
Figure 27B:
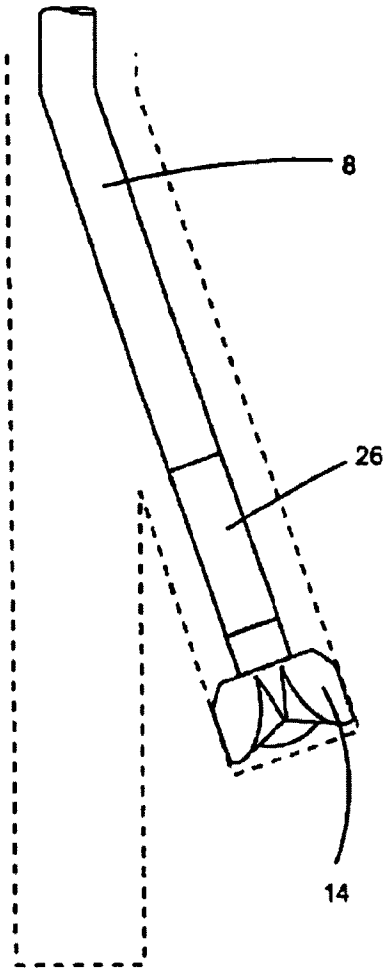
Figure 27A:
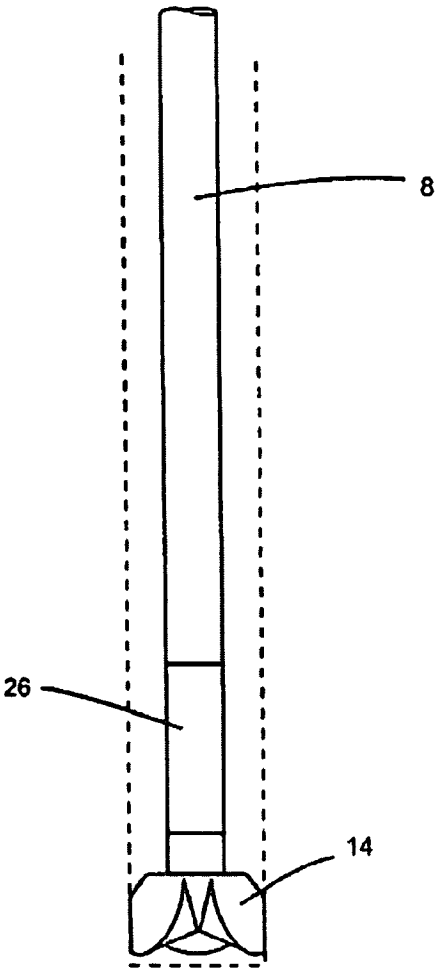

FIG. 26 shows that when tool 201 enters the drill collar 26 or the drill bit 14, it disengages the latches by, e.g., applying force, a magnetic field, or electrical power to the latching mechanism, thereby allowing the bit to be parked on the bottom of the borehole. It may be preferred to perform this parking operation in a side well to prevent the primary well from being blocked in the event re-attachment operations are unsuccessful or undesirable (e.g., when preparing to discard the bit 14). FIGS. 27*a*-27*c* illustrate this sequence.

FIG. 27*a* illustrates a drill string 8, including a drill bit 14 and drill collar 16, drilling a main borehole. FIG. 27*b* shows the situation after the drill string 8 has been raised and steered to drill a side borehole using directional drilling techniques. FIG. 27*c* shows the situation after the drill bit 14 has been detached and parked in the side borehole, and the drill string raised back into the main borehole. In this configuration, an open-hole tool 201 is extended into the main well via the interior of the drill string. Once the operations of tool 201 are complete, the tool is retracted and the drill string 8 is steered into the side borehole to reconnect with the drill bit 14. The collar or bit is preferably configured to align and latch the bit back into place in the drill collar when the two are pressed together. If the use of a side borehole is deemed undesirable, the bit 14 can be parked (and later recovered) at the bottom of the main borehole.

Where it is desired to perform logging while tripping, the tool 201 may attach to the bit 14 after the latch mechanisms 507 are disengaged. The tool 201 may seat itself in collar 26 and, as the drill string is removed from the borehole, the tool 201 can pull the drill bit 14 along to the surface as well. With the drill bit disengaged from collar 26, the tool 201 has access to the borehole walls to perform logging, sampling, or other operations.

To sum up, FIGS. 24-27*c* show an illustrative parked-bit tool system that includes a detachable tool bit 14. The drill bit is secured to the bottom-hole assembly by a latching mechanism. During drilling operations, the bit functions as a standard drill bit, removing rock from the bottom of the borehole as the drillstring rotates. When open-hole access is desired (e.g., for logging or sampling), a tool is lowered through the drill string to disengage the latching mechanism and leave the bit parked at the bottom of the borehole or in a side-bore. The drillstring can then be raised, enabling the tool to access the open borehole. In at least some embodiments, the bit can be retrieved and re-attached to the drill string to resume drilling operations.

Figure 28:
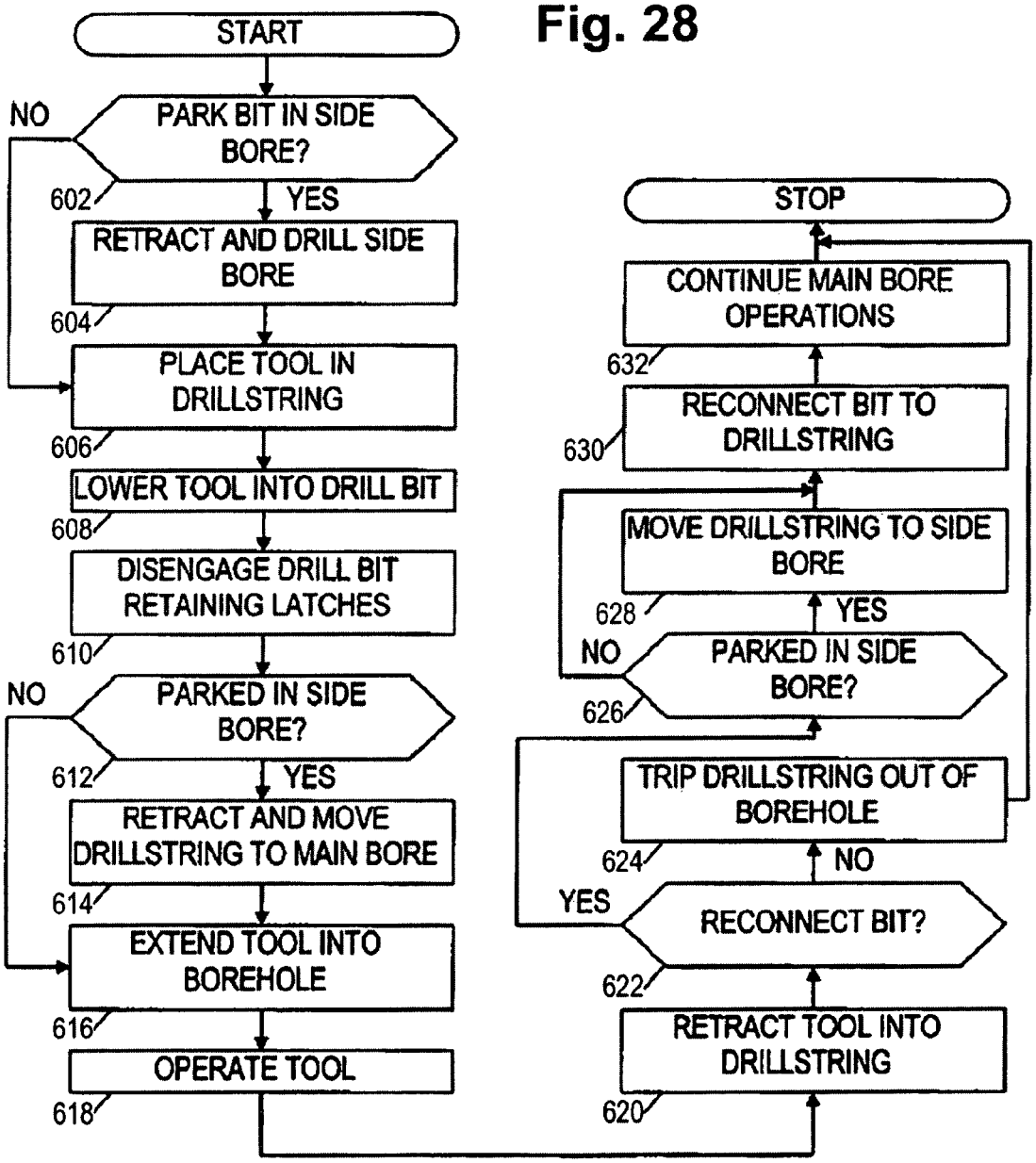
FIG. 28 shows a flow diagram of an illustrative parked-bit logging method.

FIG. 28 is a flow diagram of an illustrative method suitable for use with a bit-parking tool system. The method begins while the main borehole is being drilled. If the drillers desire to perform open hole operations, they first decide in block 602 whether the drill bit is to be parked in the main borehole or in a side hole. If they choose the main borehole, the method proceeds with block 606. Otherwise, in block 604 the driller first pulls the drill string partway out of the hole and drills a side bore using standard drilling techniques.

In block 606, tool 201 is placed in the interior of the drill string at the top of the borehole, optionally supported by a cable. In block 608, the tool descends through the drill string, possibly aided by the flow of drilling fluid and a connected cable. The tool traverses the drill string, eventually reaching the drill collar and possibly entering the drill bit. On reaching the end of the drill string in block 610, tool 201 acts to disengage the retaining latches connecting the bit to the bit collar. The latching mechanism may be disengaged by tool contact with a release mechanism in the collar, or by tool contact with the drill bit. The bit is now detached from the drill string and parked at the bottom of the borehole.

Block 612 represents a branch based on whether the bit is parked in the main borehole or a side bore. If in a side borehole, the drill string is raised and returned to the main borehole in block 614. In any event, tool 201 is extended from the drill string into the open borehole in block 616. In block 618, the tool's open hole operations are initiated, e.g. sampling or logging the borehole formation. Block 620 represents a decision regarding whether or not to reconnect the bit. If not, the drill string is tripped out of the borehole in block 622, with the tool 201 performing logging operations if desired. Otherwise, in block 624, the tool 201 is retracted in preparation for reconnecting the bit. Using the cable, tool 201 may be retrieved to the surface to clear the flow bore of the drill string.

Block 626 represents another branch based on whether the bit is parked in the main borehole or a side bore. If in a side borehole, the drill string is raised and returned to the side borehole in block 628. In block 630, the drill string is lowered onto the parked bit to reconnect the bit to the drill string. In block 632, normal drilling operations in the main borehole are resumed.

Numerous variations and modifications will become apparent to those skilled in the art once the above disclosure is fully appreciated. For example, the biasing springs can take many forms including hydraulic lines with compressible fluids. It is intended that the following claims be interpreted to embrace all such variations and modifications.

What is claimed is:

1. A drilling system that enables tool access to a borehole, the system comprising:

a drill string having a drill bit that comprises a tool port having an approximately elliptical cross-section, the drill bit further including a plug to substantially fill the tool port; and a tool that enables the tool port to be opened without attaching the plug to the tool.

2. The system of claim 1, wherein the plug is attached to the drill bit by at least one hinge that enables the plug to open outwardly.

3. The system of claim 2, wherein the plug comprises at least two hinged sections.

4. The system of claim 2, wherein the plug is configured to return to a closed position in response to motion of the drill bit or a reverse fluid flow.

5. The system of claim 1, wherein the plug is attached to the drill bit by at least one extendable pivot arm.

6. The system of claim 5, wherein the plug comprises at least two pivoting sections.

7. The system of claim 1, wherein the drill bit further comprises a biasing spring to return the plug to a closed position after the tool is retracted into the drill string.

8. The system of claim 1, wherein the plug is held in place by at least one mechanism that is disengaged by the tool.

9. The system of claim 8, wherein the plug detaches from the bit when the at least one mechanism disengages.

10. The system of claim 9, wherein the tool carries a second plug for replacing the detached plug.

11. The system of claim 10, wherein the second plug fits through the tool port.

12. The system of claim 1, wherein the tool is cable-conveyed through the interior of the drill string.

13. The system of claim 1, wherein the tool is fluid-conveyed through the interior of the drill string, and wherein the tool is seated in the tool port as the drill string is tripped from a borehole.

14. The system of claim 1, wherein the plug includes at least one nozzle for drilling fluid.

15. The system of claim 1 wherein the tool comprises at least one instrument in the group consisting of a resistivity tool, a porosity tool, a density tool, an acoustic tool, a coring tool, a sampling tool, and a downhole camera.

16. A drilling method that comprises:

drilling a borehole with a drill string having a drill bit that comprises a tool port having an approximately elliptical cross-section, the drill bit further including a plug that substantially fills the tool port; and inserting a tool into the drill string so that the tool moves through the interior of the drill string to the drill bit and opens the tool port without attaching to the plug.

17. The drilling method of claim 16, further comprising:

tripping the drill string from the borehole while the tool collects logging data about formations penetrated by the borehole.

18. The drilling method of claim 16, further comprising:

extending the tool through the tool port into the borehole to collect data;

retrieving the tool through the drill string to the surface; and resuming drilling of the borehole with a plug blocking the tool port.

19. The drilling method of claim 18, wherein the tool port plug is replaceable with another plug conveyed downhole through the interior of the drill string by the tool.

20. The drilling method of claim 18, wherein the plug is attached to the drill bit by at least one hinge that enables the plug to open outwardly.

21. The drilling method of claim 18, wherein the plug is attached to the drill bit by at least one extendable pivot arm.

* * * * *